US007313343B2

(12) United States Patent
Tanaka et al.

(10) Patent No.: US 7,313,343 B2
(45) **Date of Patent: *Dec. 25, 2007**

(54) IMAGE FORMING APPARATUS

(75) Inventors: Kuniaki Tanaka, Nagano (JP); Nobuyuki Mizushima, Nagano (JP); Hiroshi Miyazawa, Nagano (JP); Keiichi Taguchi, Nagano (JP); Toshiya Takahata, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 246 days.

This patent is subject to a terminal disclaimer.

(21) Appl. No.: 10/929,103

(22) Filed: Aug. 27, 2004

(65) Prior Publication Data

US 2005/0100361 A1 May 12, 2005

(30) Foreign Application Priority Data

| | | |
|---|---|---|
| Aug. 27, 2003 | (JP) | P2003-302423 |
| Aug. 27, 2003 | (JP) | P2003-302424 |
| Aug. 27, 2003 | (JP) | P2003-302425 |
| Aug. 27, 2003 | (JP) | P2003-302426 |
| Oct. 15, 2003 | (JP) | P2003-355260 |
| Oct. 15, 2003 | (JP) | P2003-355261 |
| Oct. 15, 2003 | (JP) | P2003-355262 |
| Oct. 15, 2003 | (JP) | P2003-355263 |

(51) Int. Cl.
*G03G 15/16* (2006.01)

(52) U.S. Cl. ..... 399/101; 399/123; 399/298; 399/308; 399/344

(58) Field of Classification Search ..... 399/101, 399/123, 298, 308, 344, 345
See application file for complete search history.

(56) References Cited

U.S. PATENT DOCUMENTS

| | | | | |
|---|---|---|---|---|
| 5,761,594 | A * | 6/1998 | Seto et al. | 399/302 |
| 7,079,798 | B2 * | 7/2006 | Suzuki et al. | 399/302 |
| 7,092,660 | B2 * | 8/2006 | Tanaka et al. | 399/227 |
| 2002/0009316 | A1 * | 1/2002 | Endo et al. | 399/349 |
| 2006/0269316 | A1 * | 11/2006 | Kyung et al. | 399/101 |

FOREIGN PATENT DOCUMENTS

| | | |
|---|---|---|
| JP | 05-88534 | 4/1993 |
| JP | 07-271142 | 10/1995 |
| JP | 07-271262 | 10/1995 |

(Continued)

*Primary Examiner*—David M. Gray
*Assistant Examiner*—Geoffrey T Evans
(74) *Attorney, Agent, or Firm*—Hogan & Hartson LLP

(57) ABSTRACT

An electrostatic latent image is formed on a rotary image carrier. A developer is provided with at least one developing roller which is separatably abutted on the image carrier at a developing position to supply toner onto the image carrier to make the latent image visible as a toner image. An intermediate transfer member is adapted to temporarily hold the toner image. A transferer applies a transfer bias to primarily transfer the toner image on the image carrier to the intermediate transfer member. A first cleaner is always abutted on the image carrier to remove toner remaining thereon. A second cleaner is separatably abutted on the intermediate transfer member to remove toner remaining thereon. The toner image includes a first toner image which is not to be transferred onto the recording medium and a second toner image which is to be secondarily transferred onto a recording medium. The second cleaner is separated from the intermediate transfer member so as to avoid the first toner image.

84 Claims, 35 Drawing Sheets

FOREIGN PATENT DOCUMENTS

| | | | |
|---|---|---|---|
| JP | 08-227201 | | 9/1996 |
| JP | 09-34213 | | 2/1997 |
| JP | 10-198116 | | 7/1998 |
| JP | 2000-250366 | | 9/2000 |
| JP | 2001-142285 | | 5/2001 |
| JP | 2002-82532 | | 3/2002 |
| JP | 2002-116608 | | 4/2002 |
| JP | 2003-66801 | | 3/2003 |
| JP | 2003-91169 | | 3/2003 |
| JP | 2003091169 | A * | 3/2003 |
| JP | 2003-248357 | | 9/2003 |

* cited by examiner

FIG. 32

| | | SINGLE PAGE | DOUBLE PAGES |
|---|---|---|---|
| SHORT SHEET | POST CARD | NOT NECESSARY | NOT NECESSARY |
| | B5 | NOT NECESSARY | NOT NECESSARY |
| MEDIUM SHEET | A4 | NOT NECESSARY | NECESSARY |
| | LETTER | NOT NECESSARY | NECESSARY |
| LONG SHEET | B4 | NOT NECESSARY | |
| | A3 | NOT NECESSARY | |

IMAGE FORMING APPARATUS

BACKGROUND OF THE INVENTION

The present invention relates to an image forming apparatus in which an electrostatic latent image is formed on an image carrier. A developing roller is retractably brought into contact with the image carrier to develop the latent image as a visible toner image. The toner image is then transferred onto an intermediate transfer member. A first cleaner is always brought into contact with the image carrier to remove toner remaining thereon after the transfer is performed. A second cleaner is retractably brought into contact with the intermediate transfer member to selectably remove toner remaining thereon.

An image forming apparatus includes, around the periphery of a photosensitive drum serving as a rotary image carrier, a charger for charging the photosensitive drum uniformly along the rotational direction thereof, an exposer for forming an electrostatic latent image on the photosensitive drum, a developer for developing the electrostatic latent image, a transferer for transferring a toner image on the photosensitive drum onto a transfer member, a cleaner for cleaning the surface of the post-transfer photosensitive drum, etc. An electrostatic latent image formed on the photosensitive drum by the exposer is developed by the developer to form a toner image. The toner image thus formed is transferred onto a transfer member and residual toner on the post-transfer photosensitive drum is removed from the photosensitive drum by the cleaner.

In a case of a rotary-type full-color image forming apparatus that forms a full-color image, color toner images, formed on the photosensitive drum by the respective developing devices for yellow Y, magenta M, cyan C, and black K, are sequentially transferred onto an intermediate transfer member to superpose colors. For this reason, the developing cartridges of respective colors of toner are detachably mounted to a rotary development unit, and each time an electrostatic latent image of one color is formed on the photosensitive drum, the rotary development unit is driven by a color switching operation to move the developing cartridge of the corresponding toner by rotation to a developing position for a developing operation to be performed. Such a configuration is disclosed in Japanese Patent Publication Nos., 2002-82532A, and 2003-66801A, for example.

In the image forming apparatus, the electrostatic latent image on the photosensitive drum is formed by repetitively exposing a light beam modulated by an image forming signal in the direction of the rotating axis of the photosensitive drum (a primary scanning direction). In a state where the photosensitive drum is rotated, the light beam is scanned to carry out an exposure, thereby forming a latent image. If the rotation of the photosensitive drum is unstable and a vibration or an unevenness is caused, picture quality is deteriorated due to so-called banding phenomenon in which a stripe appears in a secondary scanning direction.

A factor for causing the rotation of the photosensitive drum to be unstable and generating the vibration or unevenness includes the structure of the gear train of a driving system, the member abutting against the outer periphery of the photosensitive drum such as the cleaner, a rotary developing unit for carrying out a developing color switching operation in the case of full color image forming apparatus.

The cleaner serves to clean toner remaining on the photosensitive drum after the transfer when the toner image formed on the photosensitive drum is transferred onto the transfer member. In order to enhance the cleaning effect, a proper member such as a blade member is used, and furthermore, is caused to abut on the outer peripheral surface of the photosensitive drum at a constant pressure by a spring, thereby removing the residual toner from the photosensitive drum.

If the abutment pressure is low, it is a matter of course that the cleaning effect is reduced. If the abutment pressure is raised, an irregular vibration is generated with frictional sliding between the outer peripheral surface of the photosensitive drum and the cleaner. Moreover, an abutment angle of the blade member with respect to the outer peripheral surface of the photosensitive drum, or the position of a supporting point for supporting the cleaner relative to the tangential line of the photosensitive drum at the abutment point also give an influence, as explained below.

For example, since the cleaner slidably comes in contact with the surface of the photosensitive drum, a vibration is applied to the rotation of the photosensitive drum unless the cleaner is caused to slide smoothly. When a rotating velocity fluctuation such as the vibration is generated during a period for which the surface of the photosensitive drum is exposed, an electrostatic latent image cannot be formed with high precision, resulting in a deterioration in the quality of an image.

As compared with an image forming apparatus in which a developing roller always abuts on a photosensitive drum, it is observed that the velocity fluctuation of the photosensitive drum is apt to be caused in an image forming apparatus in which a developing roller is retracted from the developing position of the photosensitive drum or carries out a development switching operation. For example, in a color image forming apparatus comprising a rotary developing unit which is rotated and moved by a developing color switching operation and the mounted developing cartridge repetitively comes in contact with or separates from the photosensitive drum at each time. Accordingly, the state of the outer peripheral surface of the photosensitive drum is not held uniformly between the contact state and the separating state, the frictional sliding operation of the cleaner cannot be carried out smoothly and the speed of the photosensitive drum thus becomes unstable.

More specifically, for example, in an image forming apparatus wherein images of respective colors for two sheets are formed and developed during one circulation of an intermediate transfer belt as shown in FIG. 3, the driving operations of various motors for the photosensitive drum and the intermediate transfer belt are started and an image signal is then turned ON based on image data, so that the surface of the photosensitive drum is exposed to write an electrostatic latent image. In a case where the image forming apparatus comprises a rotary developing unit, it is necessary to carry out a color switching operation for effecting a developer (developing roller) corresponding to the color of image data, prior to the exposing process. Thereafter, the developing operation is started together with the exposure of the surface of the photosensitive drum.

The cleaner slides on the outer periphery of the photosensitive drum on which residual toner of the previous image forming operation has been removed and cleaned, until a position "m" at which the developing roller is first brought into contact reaches the cleaner with toner. Since the toner also serves as a lubricant agent between the cleaner and the photosensitive drum, the vibrations or the rotation velocity fluctuation of the photosensitive drum tends to be occurred during the above period. This period corresponds to a period indicated by t' in FIG. 3. Further, during a period "t" shown in FIGS. 2 and 3, relatively large velocity fluctuations can be observed. In such a condition, a position shift is caused on an electrostatic latent image so that the quality of an image to be formed is deteriorated. In FIG. 3, "n" indicates a position on the photosensitive drum from which the developing roller is separated, and "o" indicates a position on the photosensitive drum which is first subjected to the exposure.

The above explanation is for the case where a full color image is formed. However, the same phenomenon can be observed in a case where a monochrome color image is formed with a single color of toner as shown in FIG. 35. The same characters have the same meanings as those in FIG. 3 and repetitive explanations for those will be omitted. Further, the same phenomenon can be observed also in an image forming apparatus dedicated to form a monochrome image.

In the above image forming apparatus, the developing roller is rotated while being abutted against the outer periphery of the photosensitive drum, thereby transferring toner to the surface of the photosensitive drum to develop an electrostatic latent image as a visible toner image through electrostatic adsorption. Therefore, the toner is uselessly rubs and is thus deteriorated, and furthermore, the developing roller itself is also abraded slightly and deteriorated. In a case where an image having a single color, that is, a monochrome image is to be formed, particularly, the developing roller does not need to be switched and the developing roller is uselessly rotated for a long time as shown in FIG. 35. Particularly, a deterioration in the developer for storing black toner is promoted more quickly than that in other developers.

To suppress this deterioration, the rotation of the developing roller may be stopped (i.e., separated from an area on the photoconductive drum in which no latent image is formed) as shown in FIG. 36. However, in such a configuration, the rotation velocity fluctuation of the photosensitive drum may be generated not only when a latent image for the first page is formed but also a latent image for the third page is formed. In FIG. 36, the same characters have the same meanings as those in FIG. 3 and repetitive explanations for those will be omitted.

SUMMARY OF THE INVENTION

It is therefore an object of the invention to provide an image forming apparatus capable of preventing vibrations or rotation velocity fluctuations from being generated on the photosensitive drum without deteriorating toner and developing rollers, thereby forming an image of high quality which has an excellent durability.

In order to achieve the above object, according to the invention, there is provided an image forming apparatus, comprising:

a rotary image carrier, on which an electrostatic latent image is formed;

a developer, comprising at least one developing roller which is separatably abutted on the image carrier at a developing position to supply toner onto the image carrier to make the latent image visible as a toner image;

an intermediate transfer member, adapted to temporarily hold the toner image;

a transferer, which applies a transfer bias to primarily transfer the toner image on the image carrier to the intermediate transfer member;

a first cleaner, always abutted on the image carrier to remove toner remaining thereon; and a second cleaner, separatably abutted on the intermediate transfer member to remove toner remaining thereon, wherein:

the toner image includes a first toner image which is not to be transferred onto the recording medium and a second toner image which is to be secondarily transferred onto a recording medium; and the second cleaner is separated from the intermediate transfer member so as to avoid the first toner image.

With this configuration, since the toner of the first toner image is constantly transferred from the intermediate transfer member to the image carrier, the smooth contact between the image carrier and the first cleanser can be maintained. Accordingly, the rotation velocity fluctuation of the image carrier due to the frictional contact between the image carrier and the first cleaner can be suppressed. As a result, the latent image can be formed with high accuracy, thereby obtaining an output image with high quality.

According to the invention, there is also provided an image forming apparatus, comprising:

a rotary image carrier, on which an electrostatic latent image is formed;

a developer, comprising at least one developing roller which is separatably abutted on the image carrier at a developing position to supply toner onto the image carrier to make the latent image visible as a toner image;

an intermediate transfer member, adapted to temporarily hold the toner image;

a transferer, which applies a transfer bias to primarily transfer the toner image on the image carrier to the intermediate transfer member;

a first cleaner, always abutted on the image carrier to remove toner remaining thereon; and a second cleaner, separatably abutted on the intermediate transfer member to remove toner remaining thereon, wherein:

the toner image includes a first toner image which is not to be transferred onto the recording medium and a second toner image which is to be secondarily transferred onto a recording medium; and the first toner image is formed before the latent image formation for the second toner image is started.

With this configuration, the first toner image comes in contact with the first cleaner before the latent image formation for the second toner image is started. Accordingly, the rotation velocity fluctuation of the image carrier can be suppressed when the lateral image formation is started. As a result, the latent image can be formed with high accuracy, thereby obtaining an output image with high quality.

According to the invention, there is also provided an image forming apparatus, comprising:

a rotary image carrier, on which an electrostatic latent image is formed;

a developer, comprising at least one developing roller which is separatably abutted on the image carrier at a developing position to supply toner onto the image carrier to make the latent image visible as a toner image;

an intermediate transfer member, adapted to temporarily hold the toner image;

a transferer, which applies a transfer bias to primarily transfer the toner image on the image carrier to the intermediate transfer member;

a first cleaner, always abutted on the image carrier to remove toner remaining thereon; and a second cleaner, separatably abutted on the intermediate transfer member to remove toner remaining thereon, wherein:

the toner image includes a first toner image which is not to be transferred onto the recording medium and a second toner image which is to be secondarily transferred onto a recording medium; and the first toner image on the intermediate transfer member opposes at least a region on the image carrier where is to be come in contact with the first cleaner when the latent image formation for the second toner image is performed.

With this configuration, the first toner image comes in contact with the first cleaner before the latent image formation for the second toner image is started. Accordingly, the rotation velocity fluctuation of the image carrier during the lateral image formation can be suppressed. As a result, the latent image can be formed with high accuracy, thereby obtaining an output image with high quality.

According to the invention, there is also provided an image forming apparatus, comprising:

a rotary image carrier, on which an electrostatic latent image is formed;

a developer, comprising at least one developing roller which is separatably abutted on the image carrier at a developing position to supply toner onto the image carrier to make the latent image visible as a toner image;

an intermediate transfer member, adapted to temporarily hold the toner image;

a transferer, which applies a transfer bias to primarily transfer the toner image on the image carrier to the intermediate transfer member;

a first cleaner, always abutted on the image carrier to remove toner remaining thereon; and a second cleaner, separatably abutted on the intermediate transfer member to remove toner remaining thereon, wherein:

the toner image includes a first toner image which is not to be transferred onto the recording medium and a second toner image which is to be secondarily transferred onto a recording medium; and the first toner image is again formed when a prescribed number of the second toner image is formed.

With this configuration, the rotation velocity fluctuation of the image carrier can be reliably suppressed while saving the toner consumption.

According to the invention, there is also provided an image forming apparatus, comprising:

a rotary image carrier, on which an electrostatic latent image is formed;

a developer, comprising at least one developing roller which is separatably abutted on the image carrier at a developing position to supply toner onto the image carrier to make the latent image visible as a toner image;

an intermediate transfer member, adapted to temporarily hold the toner image;

a transferer, which applies a transfer bias to primarily transfer the toner image on the image carrier to the intermediate transfer member, the toner image including a first toner image which is not to be transferred onto the recording medium and a second toner image which is to be secondarily transferred onto a recording medium;

a cleaner, always abutted on the image carrier to remove toner remaining thereon; and a pressure adjuster, which applies a uniform pressure to an entire area of the first toner image at least when the first toner image opposes to the image carrier.

With this configuration, since the first toner image is uniformly transferred from the intermediate transfer member to the image carrier, the surface of the image carrier can be uniformly covered with the toner from the first toner image. Accordingly, the stable contact condition between the cleaner and the image carrier can be secured. As a result, the latent image can be formed with high accuracy, thereby obtaining an output image with high quality.

According to the invention, there is also provided an image forming apparatus, comprising:

a rotary image carrier, on which an electrostatic latent image is formed;

a developer, comprising at least one developing roller which is separatably abutted on the image carrier at a developing position to supply toner onto the image carrier to make the latent image visible as a toner image;

an intermediate transfer member, adapted to temporarily hold the toner image;

a transferer, which applies a transfer bias to primarily transfer the toner image on the image carrier to the intermediate transfer member; and a cleaner, always abutted on the image carrier to remove toner remaining thereon; wherein:

the toner image includes a first toner image which is not to be transferred onto the recording medium and a second toner image which is to be secondarily transferred onto a recording medium; and the first toner image includes a plurality of straight lines.

According to the invention, there is also provided an image forming apparatus, comprising:

a rotary image carrier, on which an electrostatic latent image is formed;

a developer, comprising at least one developing roller which is separatably abutted on the image carrier at a developing position to supply toner onto the image carrier to make the latent image visible as a toner image;

an intermediate transfer member, adapted to temporarily hold the toner image;

a transferer which applies a transfer bias to primarily transfer the toner image on the image carrier to the intermediate transfer member; and a cleaner, always abutted on the image carrier to remove toner remaining thereon; wherein:

the toner image includes a first toner image which is not to be transferred onto the recording medium and a second toner image which is to be secondarily transferred onto a recording medium; and the first toner image includes at least one of a halftone uniform image and a halftone dot image.

With these configurations, the surface of the image carrier can be uniformly covered with the toner from the first toner image, while saving the toner consumption. Further, the above first toner image can be formed with a simple control.

According to the invention, there is also provided an image forming apparatus, comprising:

a rotary image carrier, on which an electrostatic latent image is formed;

a developer, comprising at least one developing roller which is separatably abutted on the image carrier at a developing position to supply toner onto the image carrier to make the latent image visible as a toner image;

an intermediate transfer member, adapted to temporarily hold the toner image;

a transferer which applies a transfer bias to primarily transfer the toner image on the image carrier to the intermediate transfer member; and a cleaner, always abutted on the image carrier to remove toner remaining thereon; wherein:

the toner image includes a first toner image which is not to be transferred onto the recording medium and a second toner image which is to be secondarily transferred onto a recording medium; and the first toner image is formed in a case where a region where has been subjected to the toner removal by the cleaner comes in contact with the cleaner again before the lateral image formation for the second toner image is started.

With this configuration, the rotation velocity fluctuation of the image carrier during the lateral image formation can be suppressed, while saving the toner consumption.

According to the invention, there is also provided an image forming apparatus, comprising:

a rotary image carrier, on which an electrostatic latent image is formed;

a developer, comprising at least one developing roller which is separatably abutted on the image carrier at a developing position to supply toner onto the image carrier to make the latent image visible as a toner image;

an intermediate transfer member, adapted to temporarily hold the toner image;

a transferer, which applies a transfer bias to primarily transfer the toner image on the image carrier to the intermediate transfer member; and a cleaner, always abutted on the image carrier to remove toner remaining thereon, wherein the development roller is rotated to start supplying toner in a case where a region where has been subjected to the toner removal by the cleaner comes in contact with the cleaner again before the lateral image formation is started.

With this configuration, the developing roller is not unnecessarily rotated. Accordingly, the deterioration in the toner and the developing roller can be suppressed while reliably suppressing the rotation velocity fluctuation of the image carrier during the lateral image formation.

BRIEF DESCRIPTION OF THE DRAWINGS

The above objects and advantages of the present invention will become more apparent by describing in detail preferred exemplary embodiments thereof with reference to the accompanying drawings, wherein:

FIG. 32 shows a table for judging the necessity of the dummy image formation;

DETAILED DESCRIPTION OF THE INVENTION

Embodiments of the invention will be described below in detail with reference to the accompanying drawings.

Figure 1:
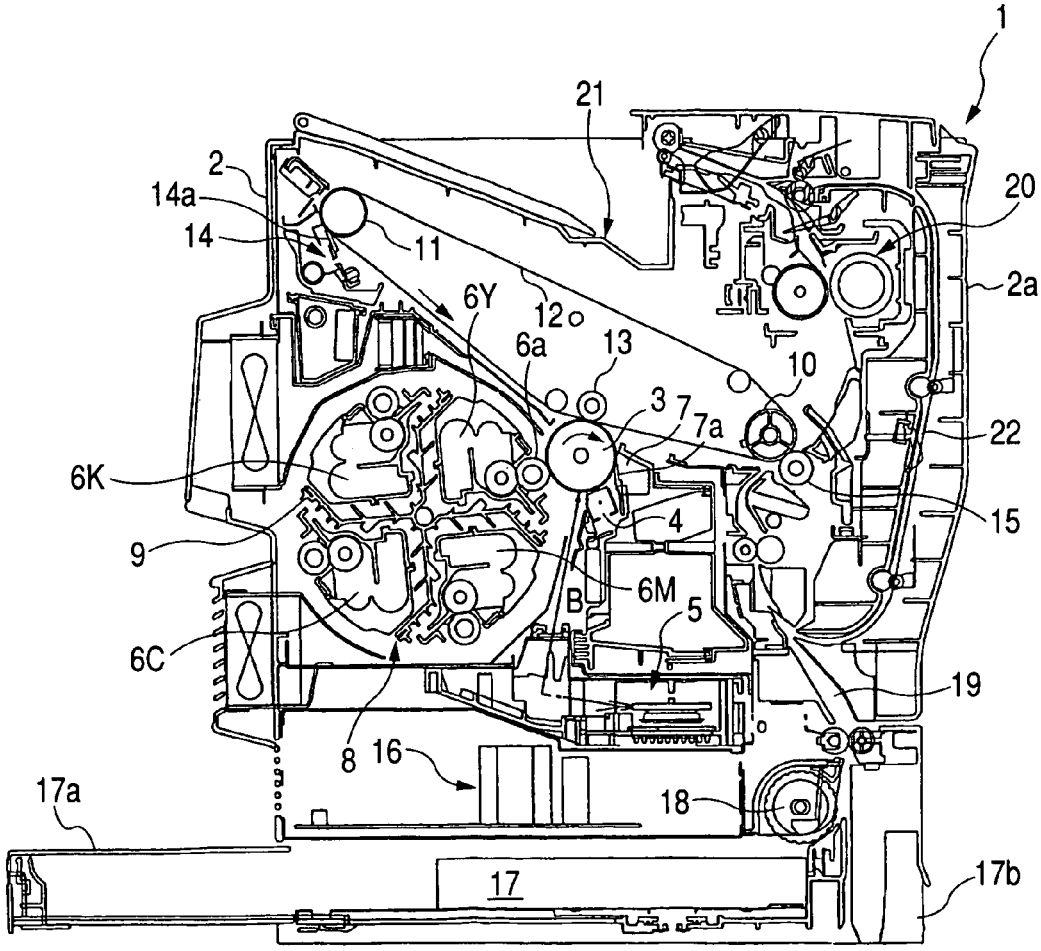
FIG. 1 is a section view showing an image forming apparatus according to a first embodiment of the invention.

As shown in FIG. 1, an image forming apparatus according to one embodiment of the invention comprises a body casing 2 provided with a sheet discharging tray 21 formed at the top portion thereof and a front door cover 2*a*. In the body casing 2, there are disposed a rotary development unit 8 in which plural toner cartridges 6C, 6M, 6Y, 6K are detachably mounted, a photosensitive drum 3 on which an electrostatic latent image is formed and a toner image is developed, an intermediate transfer unit onto which the toner image on the photosensitive drum 3 is transferred, a control unit to control respective driving motors and bias voltages, a power supply 16, a sheet feeding tray 17 containing recording media (e.g., sheets of paper), a fuser 20 to fix a toner image on a recording medium, etc. Also, inside the front cover 2*a* is provided a medium transporter 22 to transport a recording medium from the sheet feeding tray 17 to the fuser 20 through a secondary transfer roller 15. In addition, each unit is detachably provided in the main body, so that each unit is independently repaired or replaced during a maintenance work.

The photosensitive drum 3, serving as an image carrier, includes a conductive base material of a thin cylindrical shape, and a photosensitive layer formed on the surface thereof. Around the periphery of the photosensitive drum 3 are provided a charger 4 to uniformly charge the outer circumferential surface of the photosensitive drum 3, an exposer (or an image writer) 5 to form an electrostatic latent image on the photosensitive drum 3, the rotary development unit 8 to develop the electrostatic latent image, an intermediate transfer belt 12 onto which the toner image on the photosensitive drum 3 is primarily transferred, the intermediate transfer unit to perform primary transfer for the toner image to be transferred onto the intermediate transfer belt 12, a cleaner 7 to clean the surface of the photosensitive drum 3 after the primary transfer is performed.

The intermediate transfer unit comprises: a driving roller 10; a follower roller 11; the intermediate transfer belt 12, which is an endless belt stretched by these rollers 10 and 11 and is circulated in a direction indicated by an arrow in FIG. 1; a primary transfer roller 13, provided oppositely to the photosensitive drum 3 on the back side of the intermediate transfer belt 12, to perform primary transfer for the toner image on the photosensitive drum 3 to be transferred onto the intermediate belt 12; a belt cleaner 14 to remove residual toner on the intermediate transfer belt 12; and the secondary transfer roller 15, provided oppositely to the driving roller 10, to perform secondary transfer for a toner image formed on the intermediate transfer belt 12 to be transferred onto a recording medium (e.g., a sheet of paper).

The power supply 16 is provided below the exposer 5, and the sheet feeding tray 17 is provided at the bottom of the body casing 2. A recording medium in the sheet feeding tray 17 is transported to the sheet discharge tray 21 by way of a pick-up roller 18, a transportation path 19, the secondary transfer roller 15, and the fuser 20. A holder 17*b* is attached to the sheet feeding tray 17 so as to be pulled out forward from the apparatus, and in order to handle a sheet of paper of a larger size, an auxiliary tray 17*a*, protruding from behind the apparatus, is attached so as to be pulled out from the apparatus.

With the image forming apparatus 1 configured as described above, when an image forming signal is inputted into the exposer 5, the photosensitive drum 3, a developing roller 6*a* provided with each toner cartridge in the rotary development unit 8, and the intermediate transfer belt 12 are driven under the control of the control unit, and the outer circumferential surface of the photosensitive drum 3 is uniformly charged first by the charger 4. Subsequently, the surface of the photosensitive drum 3 is selectively exposed by the exposer 5 according to image information to form an electrostatic latent image.

In this instance, the rotary development unit 8 is rotated such that the developing roller 6*a* of the toner cartridge is brought into contact with the photosensitive drum 3. The electrostatic latent image is made visible as a toner image formed on the photosensitive drum 3. The toner image is transferred onto the intermediate transfer belt 12 by the primary transfer roller 13 to which a primary transfer voltage of a polarity opposite to a toner charging polarity is being applied. Toner remaining on the photosensitive drum 3 is then removed by the cleaner 7.

In a full-color image forming apparatus, toner cartridges 6Y, 6M, 6C, and 6K, respectively corresponding to yellow Y, magenta M, cyan C, and black K, are detachably mounted to the rotary development unit 8. During an image forming operation, the surface of the photosensitive drum 3 is selectively exposed by the exposer 5 according to image information of a first color, for example, yellow Y, to form an electrostatic latent image of yellow Y. In this instance, the rotary development unit 8 moves by rotation in such a manner that the developing roller 6*a* of the toner cartridge 6Y of yellow Y abuts on the photosensitive drum 3 for a toner image of the electrostatic latent image of yellow Y to be formed thereon. The toner image is subsequently transferred onto the intermediate transfer belt 12 by the primary transfer roller 13 to which the primary transfer voltage of a polarity opposite to a toner charting polarity is being applied.

During the foregoing operations, the belt cleaner 14 and the secondary transfer roller 15 are kept spaced apart from the intermediate transfer belt 12. By repetitively performing a series of these operations for image forming signals of a second color, a third color, and a fourth color, toner images of yellow Y, magenta M, cyan C, and black K corresponding to the contents of the respective image forming signals are transferred from the photosensitive drum 3 to be superposed sequentially on the intermediate transfer belt 12, and as a result, a full-color image of four colors is formed thereon.

At a timing at which a full-color image in which the respective colors of toner images are superposed reaches the secondary transfer roller 15, a recording medium in the feed tray 17 is transferred from the pick-up roller 18 to the secondary transfer roller 15 via the transportation path 19, and the secondary transfer roller 15 is pressed against the intermediate transfer belt 12 while being applied with a secondary transfer voltage. The full-color toner image on the intermediate transfer belt 12 is thereby transferred onto the recording medium by the secondary transfer roller 15. When the recording medium, onto which the full-color toner image has been transferred in this manner, is transferred to the fuser 20 via the medium transporter 22, the toner image on the recording medium is heated and pressurized by the fuser 20 to be fixed thereon. Toner remaining on the intermediate transfer belt 12 is then removed by the belt cleaner 14.

In the case of double-sided printing, a recording medium coming out from the fuser 20 is switched back so that the rear end comes to the forefront, and is fed to the secondary transfer roller 15 again by way a double-sided printing transportation path in the medium transporter 22. A full-color toner image on the intermediate transfer belt 12 is then transferred onto the other side of the recording medium, and is fixed thereon through heating and pressuring by the fuser 20 again, after which the recording medium is discharged onto the sheet discharge tray 21.

In this embodiment, four toner cartridges 6Y, 6M, 6C, and 6K are mounted to the rotary development unit 8 to constitute a full-color image forming apparatus of four colors. However, the toner cartridge 6K for the toner of black K alone may be mounted to constitute a monochrome image forming apparatus, in which the toner cartridge 6K stands by at the stand-by position (home position), and when an image is formed, the toner cartridge 6K of black K moves by rotation from the stand-by position to the developing position to develop an electrostatic latent image on the photosensitive drum 3 into a toner image. This allows the use of the rotary development unit 8 of the same design specifications for both full-color and monochrome images. By using the common specifications for full-color and monochrome images, it is possible to remarkably save the maintenance, design, and manufacturing costs in comparison with a case where an image forming apparatus is designed separately for a full-color image and a monochrome image.

Figure 5:
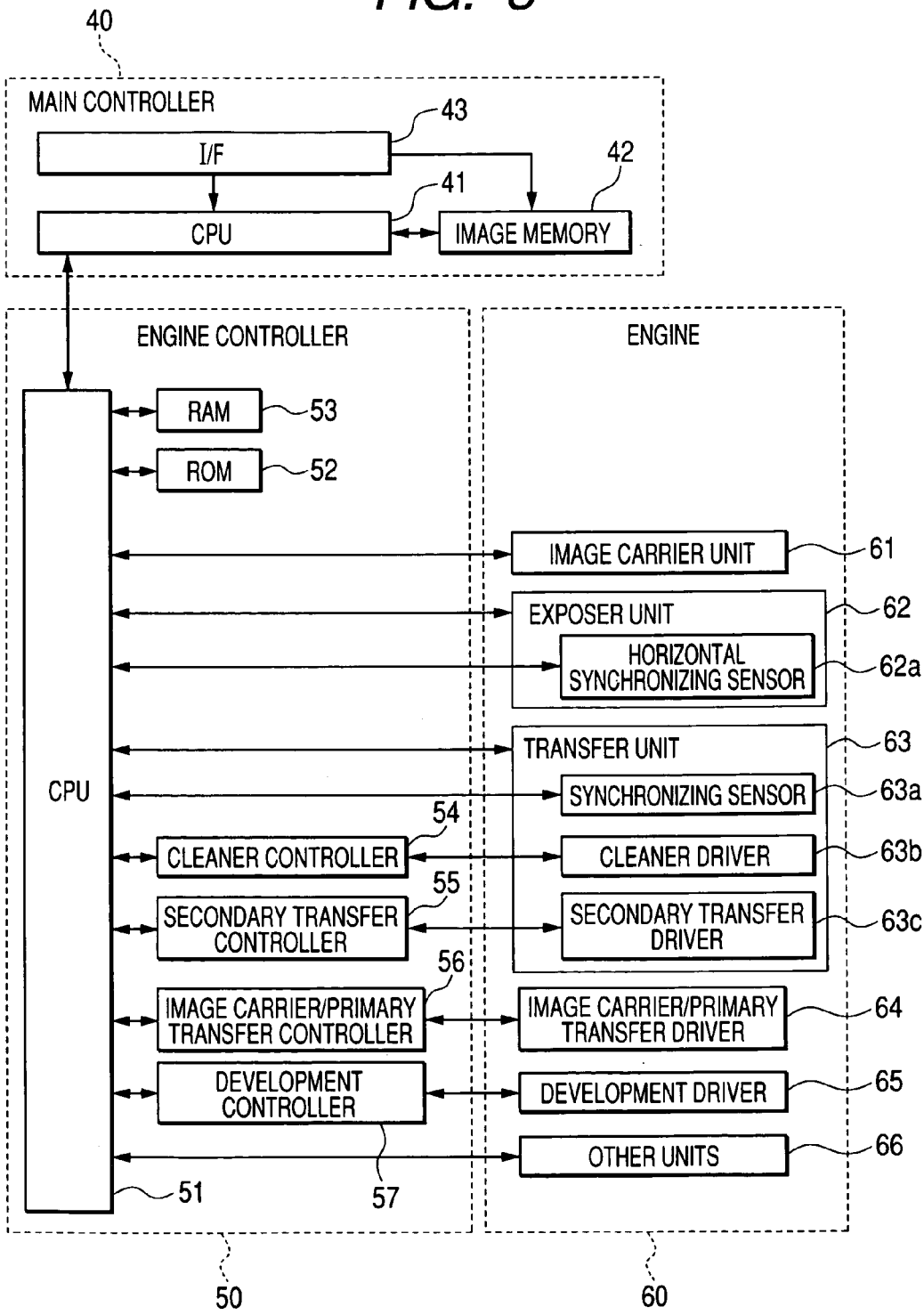
FIG. 5 is a block diagram showing an electric configuration of the image forming apparatus of FIG. 1.

As shown in FIG. 5, the image forming apparatus 1 has such a structure that a main controller 40 and an engine controller 50 are connected to each other to control an engine 60 including members to be driven of the respective portions in the apparatus 1. The main controller 40 inputs a command based on image data fed from an external device to the engine controller 50 to control the engine 60, thereby forming an image on the recording medium.

The main controller 40 includes a CPU 41 for transferring various signals together with the external device to execute the print-out (image formation) of image data (an image signal), an image memory 42 for storing the image data fed from the external device, and an interface (I/F) 43 to be connected to the external device. The CPU 41 generates a control signal based on various input signals fed from the external device through the I/F 43 and outputs the control signal to the engine controller 50, and furthermore, outputs the image data stored in the image memory 42 to the engine controller 50 in response to the signal to be transferred together with the engine controller 50.

The engine controller 50 includes a CPU 51 connected to the CPU 41 of the main controller 40 to transfer various signals and to feed a control signal to a driven member 60 of each portion of the apparatus 1, a ROM 52 for storing a program and a parameter for controlling the engine 60, and a RAM 53 to be utilized as a work area for storing the driving conditions of the engine 60 and carrying out temporary storage in driving and control operations. The engine controller 50 communicates various signals through various control circuits of the engine 60 which are properly designed and incorporated corresponding to each portion of the apparatus 1. For example, a cleaner controller 54 for removing a residual toner on the intermediate transfer belt 12, a secondary transfer controller 55 for transferring a toner image to be an actual image on the intermediate transfer belt 12 to the recording medium, an image carrier/primary transfer controller 56 for controlling the rotating and driving operations of the photosensitive drum 3 and the intermediate transfer belt 12, and a development controller 57 for developing an electrostatic latent image on the photosensitive drum 3 as a toner image are provided between the engine controller 50 and the engine 60.

The engine 60 includes: an image carrier unit 61 including the photosensitive drum 3 and the charger 4; an exposer unit 62 including the exposer 5; a transfer unit 63 including the intermediate transfer belt 12; an image carrier/primary transfer driver 64 for rotating and driving the photosensitive drum 3 and the intermediate transfer belt 12; a development driver 65 for driving the rotary development unit 8; and other units 66 for driving the fuser 20 and the medium transporter 22 and so on.

The image carrier unit 61 causes the charger 4 to charge an outer peripheral surface of the photosensitive drum 3 in response to a control signal sent from the CPU 51 of the engine controller 50. The exposer unit 62 causes the exposer 5 to irradiate the charged surface of the photosensitive drum 3 with a light beam B emitted from a laser diode or the like in response to a control signal based on image data transmitted from the CPU 51. Furthermore, the light beam B is reflected by a polygon mirror rotated by a scanner motor, such that the surface of the photosensitive drum 3 is scanned horizontally (i.e., the primary scanning direction) synchronously with the rotation of the photosensitive drum 3, in response to a sensor signal sent from a horizontal synchronizing sensor 62*a*.

The transfer unit 63 includes a synchronizing sensor 63*a*, a cleaner driver 63*b* and a secondary transfer driver 63*c*. The synchronizing sensor 63*a* is constituted by an encoder and serves to detect the circulating operation of the intermediate transfer belt 12 wound around the rollers 10 and 11. To synchronize the circulative position of the intermediate transfer belt 12 with the operation timings of the cleaner driver 63*b* and the secondary transfer driver 63*c*, a sensor signal (vsync signal) is communicated between the synchronizing sensor 63*a* and the CPU 51. The cleaner driver 63*b* causes a cleaner blade 14*a* in the belt cleaner 14 to retractably bring into contact with the surface of the intermediate transfer belt 12 to remove toner remaining thereon. The secondary transfer driver 63*c* causes the secondary transfer roller 15 to come in pressure contact with the surface of the intermediate transfer belt 12 in response to a control signal generated from the secondary transfer controller 55 of the CPU 51, thereby transferring a toner image to be an actual image on the intermediate transfer belt 12 onto the recording medium fed and held between the intermediate transfer belt 12 and the secondary transfer roller 15.

The image carrier/primary transfer driver 64 is constituted by a stepping motor, and rotates and drives the photosensitive drum 3 and the intermediate transfer belt 12 in response to a control signal sent from the CPU 51 of the engine controller 50. The development driver 65 rotates a rotary frame 9 of the rotary development unit 8 in order to cause a developing roller 6*a* in the developer 6 to rotate in response to a control signal sent from the CPU 51 of the engine controller 50, and regulates the driving timing of the developing roller 6*a* to supply toner to the surface of the photosensitive drum 3. The developer 6 stores toner for each of yellow (Y), cyan (C), magenta (M) and black (K) every color.

The other units 66 serve to control the driving operation of each of other portions of the apparatus 1 in response to the control signal sent from the CPU 51 of the engine controller 50. For example, the heating operation of the fuser 20 is controlled in response to a control signal based on the sensor signal of the synchronizing sensor 63*a* and a control signal based on the detecting signal of the recording medium during a delivery. Moreover, the driving operations of various rollers of the medium transporter 22, thereby recording an image on the recording medium with high precision.

Consequently, the image forming apparatus 1 can record an image on the recording medium while synchronizing the driving timing of each portion of the apparatus 1. For example, in a case where a toner image to be an actual image corresponding to two pages is to be formed on the intermediate transfer belt 12 in order to continuously form an image on two recording papers P, it can be supposed that the operation of each portion of the apparatus 1 is controlled in timings shown in FIG. 3.

First of all, the motor driving operations of the photosensitive drum 3 and the intermediate transfer belt 12 are started in response to a control signal sent from the CPU 51 of the engine controller 50, and a necessary control operation for forming an image, for example, the driving operation of the scanner motor of the exposer 5 is started. When a sensor signal is received from the synthesizing sensor 63*a*, it is executed the color switching operation in which the rotary development unit 8 is rotated in such a manner that the toner for the black (K) to be a first color can be supplied, and the developing roller 6*a* is abutted on the photosensitive drum 3.

Then, the light beam B emitted from the exposer 5 based on image data for a first page having a pertinent color is scanned over the photosensitive drum 3 charged uniformly by the charger 4 to expose and form an electrostatic latent image upon the completion of the color switching operation. Subsequently, an electrostatic latent image based on image data for a second page is exposed and formed on the photosensitive drum 3 recharged uniformly by the charger 4.

When it is detected that the intermediate transfer belt 12 makes a rotation upon receipt of a next sensor signal sent from the synchronizing sensor 63*a*, the color switching operation is performed to effect the developer of toner for the cyan (C) to be a second color. An exposing process is then performed based on image data of the pertinent color for the first and second pages. The exposing process is performed every time the sensor signal is received from the synchronizing sensor 63*a*, and an electrostatic latent image based on image data for the magenta to be a third color and the yellow (Y) to be a fourth color are thus formed repetitively on the photosensitive drum 3.

In parallel with the exposing process, subsequent to the color switching operation, the developing roller 6*a* is rotated so that the electrostatic latent image formed on the photosensitive drum 3 is developed with toner of the pertinent color based on the image data for the first page, thereby forming a toner image to be an actual image on the photosensitive drum 3. When the toner image is carried to a position in which the intermediate transfer belt 12 and the photosensitive drum 3 are pressed in contact by the primary transfer roller 13, a bias for transferring the toner image is applied from the photosensitive drum 3 onto the intermediate transfer belt 12, thereby forming toner images for first and second pages on the intermediate transfer belt 12 continuously.

This is repetitively carried out for the black (K) to be the first color, the cyan (C) to be the second color, the magenta (M) to be the third color and the yellow (Y) to be the fourth color in this order, thereby forming a full color toner image on the intermediate transfer belt 12. When the color toner image is carried to a position in which the second transfer roller 15 presses the delivered recording medium against the intermediate transfer belt 12 by pressure corresponding to the transfer for the yellow (Y) to be the fourth color, thereafter, a bias for transferring the toner image is applied from the intermediate transfer belt 12 to the recording medium. Consequently, the color toner image is transferred on the recording medium and is subjected to fixing operation at the fuser 20.

A cleaner blade 7*a* in the cleaner 7 is adapted to be brought into contact with the outer periphery of the photosensitive drum 3 to remove toner remaining thereon after the primary transfer is performed. There is a time period in which the cleaner blade 7*a* slides on the surface of the photosensitive drum 3 which has been cleaned by the cleaner blade 7*a* itself, after the color switching operation is performed.

Figure 3:
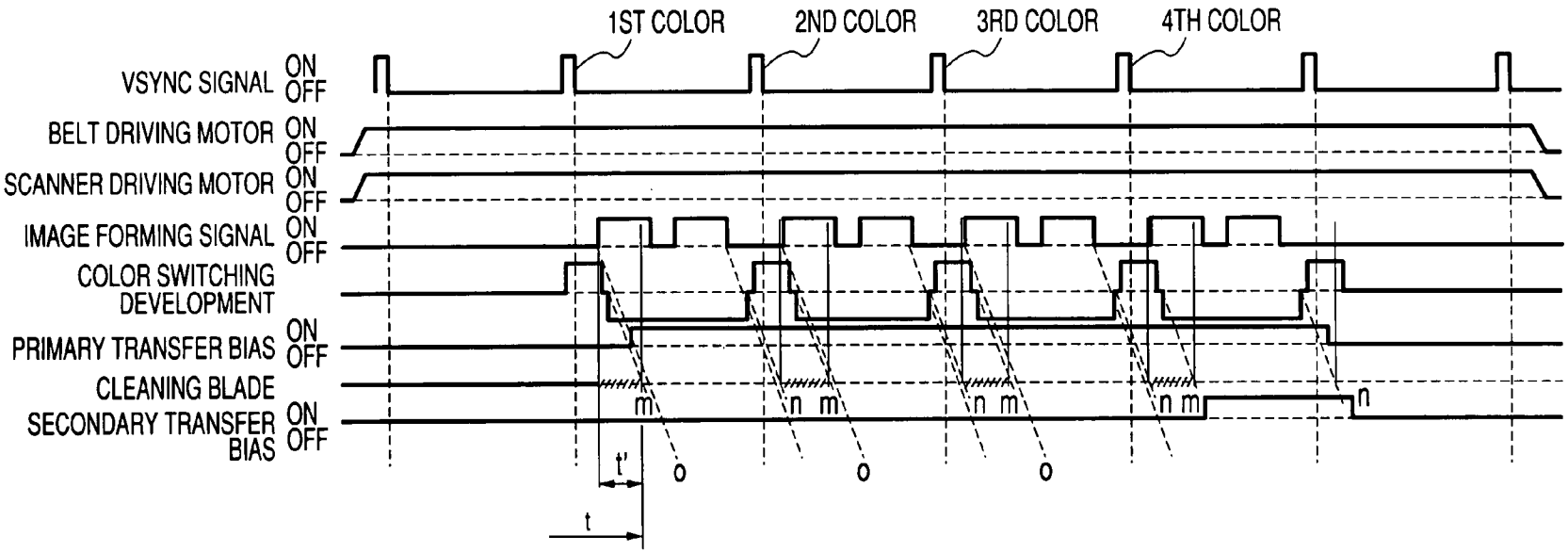
FIG. 3 is a diagram for explaining generation of the rotation velocity irregularities.

More specifically, the cleaner blade 7*a* comes in sliding contact with a region on the photosensitive drum 3 from the position "n" from which the developing roller 6*a* is separated to the position "m" to which the developing roller 6*a* comes in contact, during the exposing processing for the first page which is performed in response to a sensor signal from the synchronizing sensor 63*a* (see FIG. 3). Accordingly, the rotation velocity fluctuation is occurred until a region on the photosensitive drum 3 where the developing roller 6*a* has not abutted passes the slide contact position of the cleaner blade 7*a* (i.e., the period t). If the exposure processing is performed during the period t (this condition is indicated by t' in FIG. 3), the quality of an electrostatic latent image formed during the period t' is deteriorated.

Figure 2:
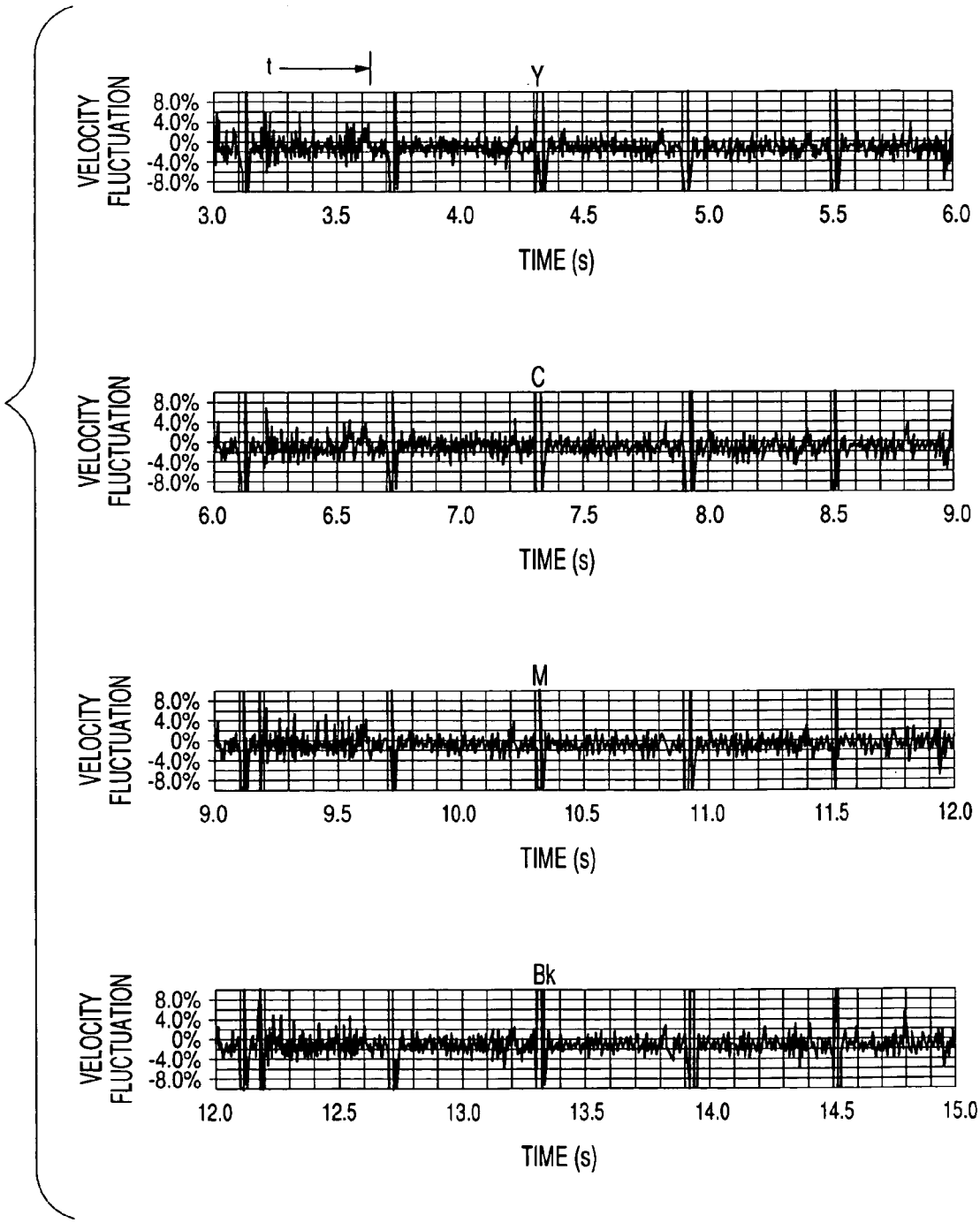
FIG. 2 is measurement data showing irregularities in the rotation velocity of a photosensitive drum.

FIG. 2 shows the result of an actual measurement which is obtained by measuring precision in the rotation of the photosensitive drum 3 for each color of the toner, and an axis of ordinates represents of the rotation velocity fluctuations (i.e., deviation from the designed value in percentage), while an axis of abscissa represents an integrating time after the sensor signal of the synchronizing sensor 63*a* is received while the intermediate transfer belt 12 is circulated. From the result of the measurement, it is apparent that the relatively large velocity fluctuations are generated for the period t after the color switching operation is performed upon receipt of the sensor signal of the synchronizing sensor 63*a*. The periodic appearance of the great velocity fluctuation after the period t represents the noise on the signal of the synchronizing sensor 63*a* due to the seam of the intermediate transfer belt 12.

The CPU 51 of the engine controller 50 starts the driving and control operations of the transfer unit 63 and the development driver 65 based on the sensor signal sent from the synchronizing sensor 63*a* which is detected (a sensor signal detected before a synchronizing signal for the first color) simultaneously with the start of a necessary control operation for an image formation of the photosensitive drum 3 or the intermediate transfer belt 12.

An area where irregularities in the rotation velocity of the photosensitive drum 3 are generated due to the operation sequence will now be described in more detail with reference to FIG. 3. In this figure, there are shown the on/off states of a vertical synchronous (vsync) signal, a motor for driving the intermediate transfer belt 12, a motor for driving the exposer 5, the image forming signal, the primary transfer bias and the secondary transfer bias. There is also shown a state of the developing roller 6*a*, that is, the developing roller is subjected to the color switching operation or the developing operation.

The oblique line "m" indicates the movement of a position on the photosensitive drum 3 at which the developing roller 6*a* comes in contact. That is, an intersection between the oblique line "m" and the horizontal line labeled as "cleaner blade" means that the position at which the development roller 6*a* comes in contact reaches the abutment point of the cleaner 7.

Similarly, the oblique line "n" indicates the movement of a position on the photosensitive drum 3 at which the developing roller 6*a* separates to be subjected to the color switching operation. That is, an intersection between the oblique line "n" and the horizontal line labeled as "cleaner blade" means that the position at which the development roller 6*a* separates reaches the abutment point of the cleaner 7.

As is shown in FIG. 3, the intermediate transfer belt 12 and the exposer 5 starts driving first. Then the color switching operation of the rotary development unit 8 is performed. At a timing derived from the vsync signal, the exposer 5 forms a latent image based on the image forming signal and the latent image is made visible as a toner image by the developing roller 6*a*.

As is shown in FIG. 1, the exposing point on the photosensitive drum 3 is on the upstream side of rotations from the developing position, the developing roller 6*a* may be abutted on the photosensitive drum 3 after the image forming signal is activated (the exposure is performed) but before the exposing point reaches the developing position (the intersection between the oblique line "o" and the horizontal line labeled "color switching and development").

After that, the primary transfer bias is applied when the toner image reaches the primary transfer position (the intersection between the oblique line "o" and the horizontal line labeled "primary transfer bias") to primarily transfer the toner image onto the intermediate transfer belt 12.

Hence, for a time period t' from the point in time at which the image forming signal is activated to the point in time at which the development roller 6*a* comes in contact reaches the abutment point of the cleaner 7, an area of the photosensitive drum 3 in which the developing roller 6*a* has not been abutted (that is, toner as the lubricant is absent) is subjected to the frictional contact with the cleaner 7. The time period t' is therefore an area where irregularities in the rotation velocity of the photosensitive drum 3 are generated. For the second through fourth colors, this area is similarly defined as a time period between the intersections of the oblique lines m and n with respect to the horizontal line labeled as "cleaner blade".

In this embodiment, the toner is supplied to the photosensitive drum 3 while the developing roller 6*a* is separated therefrom by the color switching operation. More specifically, the supply of the toner is carried out in such a manner that a dummy image is formed on the intermediate transfer belt 12 and reversely transferred to the photosensitive drum 3, so that toner exists on an area that is opposed to the cleaner blade 7*a* after the exposure processing is started. The reverse transfer of the toner (i.e., the dummy image) is carried out by the mechanical peeling force generated by the contact between the intermediate transfer belt 12 and the photosensitive drum 3, or by a transfer bias controlled in accordance with the toner amount (the density of the dummy image) or the contact pressure therebetween.

Before the image signal is turned ON to activate the exposure processing, the rotation velocity fluctuations do not directly influence the image quality. Therefore, it is an essential requirement that toner exists on the area on the photosensitive drum 3 that is opposed to the cleaner blade 7*a* after the exposure processing is started. In a case where the developing roller 6*a* comes in contact in such an area of the photosensitive drum 3 when the exposure processing is started, the above requirement is satisfied because fogging toner is supplied from the developing roller 6*a*.

In order to transfer the toner image reversely from the intermediate transfer belt 12 onto the photosensitive drum 3, it is necessary to keep the belt cleaner 14 spaced apart so that the toner present on the intermediate transfer belt 12 will not be removed until it is transported to the primary transfer point. The toner image on the intermediate transfer belt 12 may be the above described dummy image or the fogging toner transferred from the photosensitive drum 3 at the primary transfer point.

The formation of the dummy image will be described with reference to FIG. 4 which is analogous to FIG. 3.

In this embodiment, the color switching operation is first carried out in such a manner that the rotary developing unit 8 is rotated to place the development cartridge for the first color at the development position, and a dummy image (black-painted part) is formed on an area on the photosensitive drum 3 where the developing roller 6*a* has not abutted during the color switching operation. The dummy image is transferred onto the intermediate transfer belt 12 (indicated by an arrow 1) at the primary transfer position.

Figure 4:
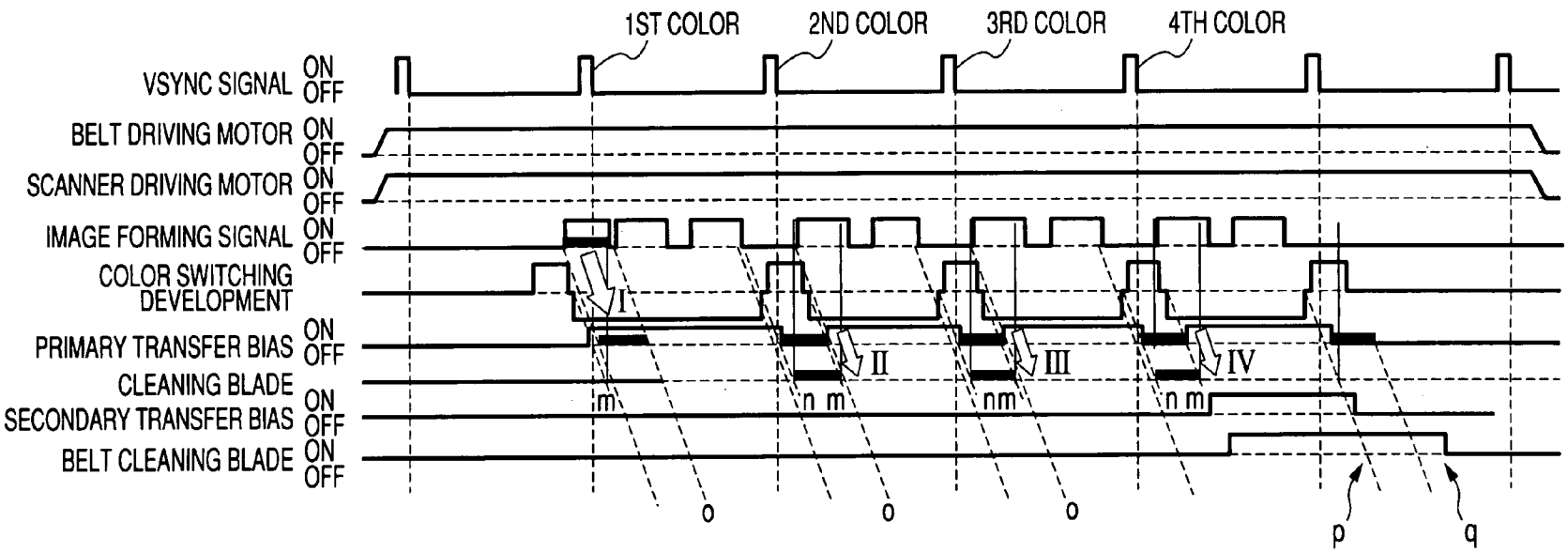
FIG. 4 is a diagram for explaining a dummy image formation performed in the image forming apparatus of FIG. 1.

As is apparent from the operation sequence in FIG. 4, the leading end of the dummy image reaches the slide contact position of the cleaner blade 7*a* while the formation of the dummy image is still in progress. Thus, even if the exposure processing for the first color is immediately after the completion of the dummy image formation, the toner for the dummy image is remaining on the photosensitive drum 3, so that the cleaner blade 7*a* is kept being in the smooth sliding contact, thereby preventing the occurrence of the rotation velocity fluctuation of the photosensitive drum 3.

Further, since the dummy image is formed immediate before the image formation of the first color, the start timing of the image formation can be brought forward while avoiding the banding phenomenon.

For the image formation of the second, the third and the fourth colors, the primary transfer bias is controlled such that the dummy image is reversely transferred from the intermediate transfer belt 12 onto an area of the photosensitive drum where the developing roller 6*a* has not abutted during the color switching operation (indicated by arrows II, III and IV). It is thus possible to eliminate a time duration during which the toner is absent on the abutting portion between the photosensitive drum 3 and the cleaner blade 7*a* at least while a latent image is formed by an exposing beam B.

While the developing roller 6*a* is abutted on the photosensitive drum 3, fogging toner may be supplied even if any toner image is formed thereon, so that the fogging toner serves as the lubricant. When the toner image formed and transferred onto the intermediate transfer belt 12, the toner residual on the photosensitive drum 3 may serve as the lubricant.

In view of the above, a slight quantity is sufficient for the toner to be transferred reversely as the lubricant from the intermediate transfer belt 12 onto the photosensitive drum 3. It is thus possible to transfer the dummy image reversely from the intermediate transfer belt 12 little by little repetitively more than once, by controlling a quantity of toner to be transferred reversely at the primary transfer point. The number of repetition times can be controlled by the number of image formations or a quantity of toner used for the dummy image, or the bias used for inverse transfer.

Figure 6:
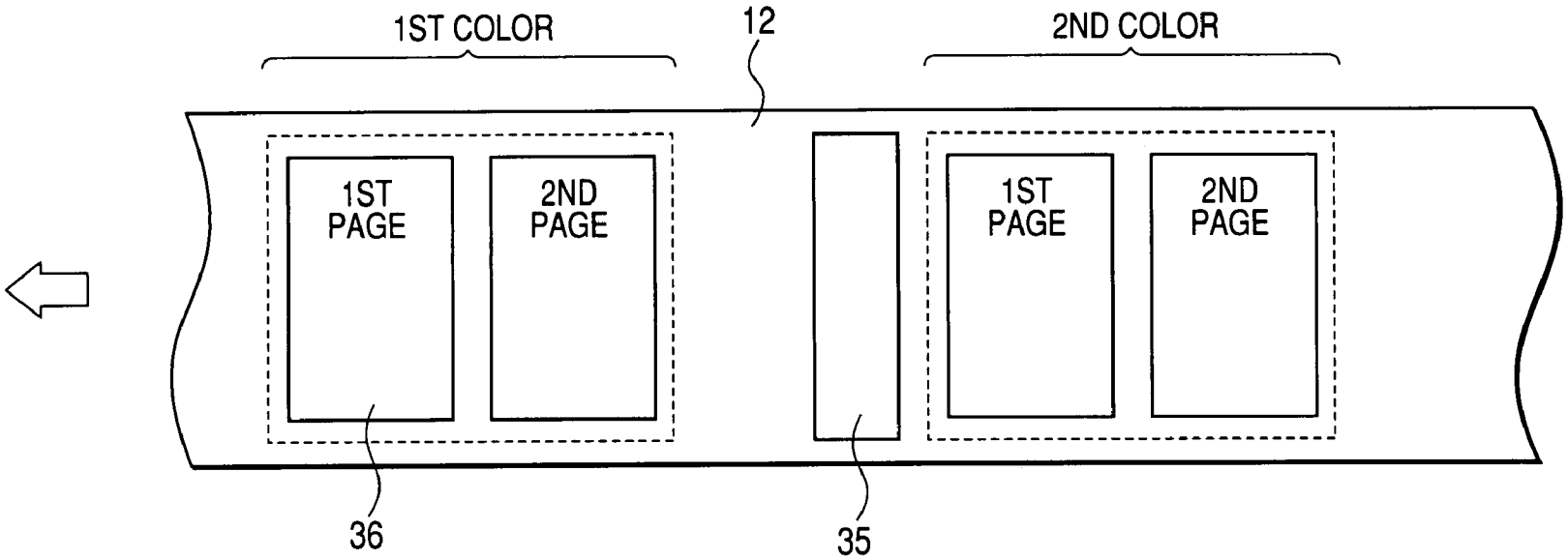
FIG. 6 is a diagram showing a position where the dummy image is formed.

More specifically, as shown in FIG. 6, a dummy image 35 is formed between actual images 36 for the second page of the first color and the first page of the second color, which corresponds to the timing that the color switching operation of the rotary development unit 8 is performed.

Figure 7:
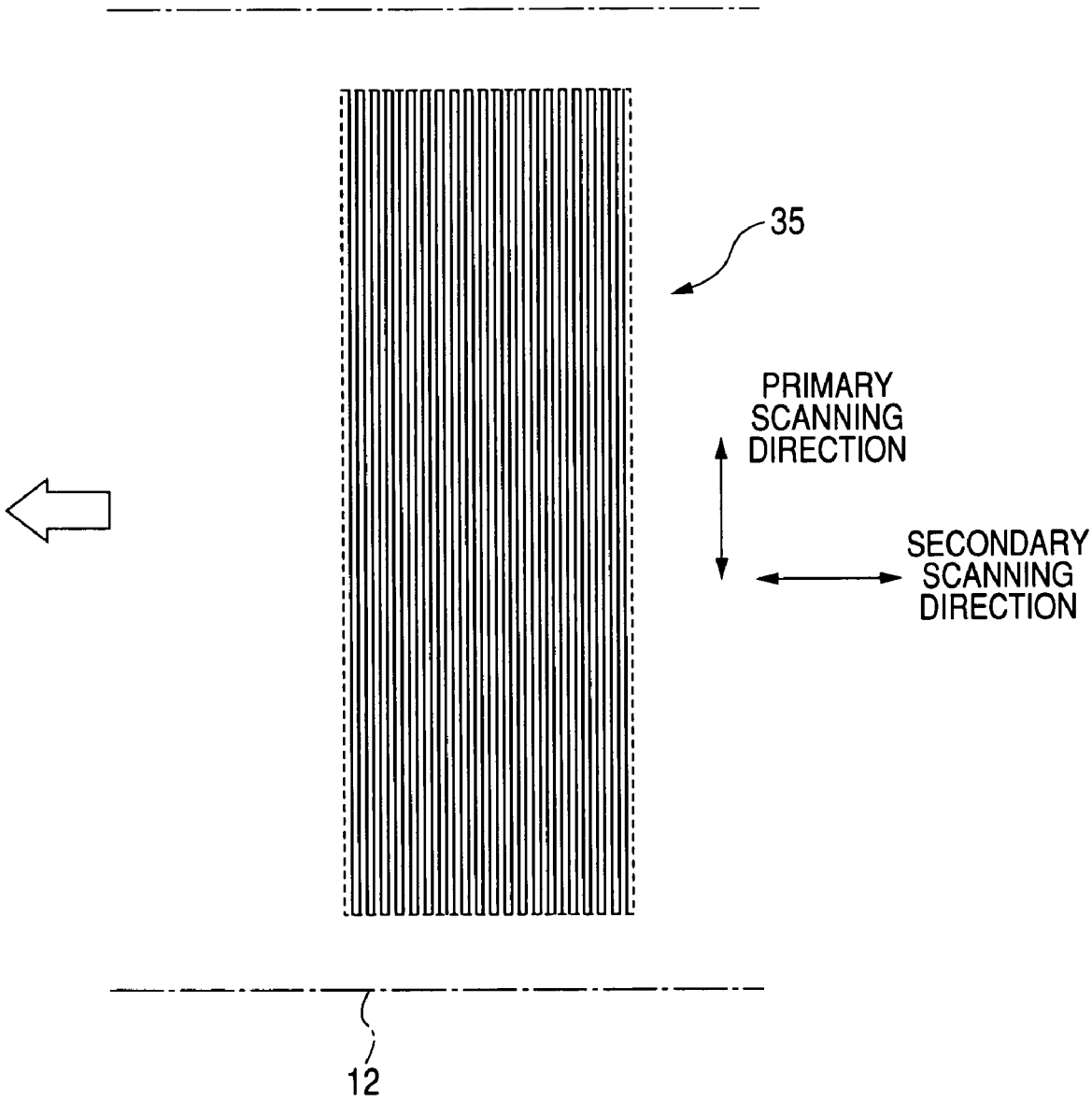
FIG. 7 is a plan view showing one example of the dummy image.

As shown in FIG. 7, the dummy image 35 is a toner image in which a plurality of lines extending in the primary scanning direction are arrayed in the secondary scanning direction. The primary scanning direction corresponds to the axial direction of the photosensitive drum 3 and the width direction of the intermediate transfer belt 12, and the secondary scanning direction corresponds to the rotating direction of the photosensitive drum 3 and the circulating direction the intermediate transfer belt 12. Such a toner image can be obtained from an electrostatic lateral image formed by alternately turning on and off the exposing beam B scanning over the photosensitive drum 3 in the primary scanning direction, in accordance with the driving control program of the exposer 5 which is stored in the ROM 52 in advance.

Since the toner image 35 is configured the above, the toner reversely transferred onto the photosensitive drum 3 forms a plurality of lines extending perpendicularly to the rotating direction of the photosensitive drum 3.

For this reason, the toner intermittently comes in contact with the cleaner blade 7*a*. The toner is not fixed on the surface of the photosensitive drum 3 but serves as a lubricant while it is moved by the cleaner blade 7*a*. Therefore, the toner is present in such a state as to uniformly cover the surface of the photosensitive drum 3 substantially. Consequently, it is possible to reliably avoid the rotation velocity fluctuations of the photosensitive drum 3, so that an electrostatic latent image can be formed on the surface of the photosensitive drum 3 with high quality.

On the other hand, it is possible to simply and easily form the toner image 35 to be the dummy image by causing the exposer 5 to simply turn on and off the exposing beam B for scanning over the photosensitive drum 3 without occupying a memory. Moreover, the toner image 35 to be the dummy image is not a so-called solid image to be formed by always irradiating the exposing beam B. Consequently, a large amount of the toner is not consumed. Thus, it is possible to obtain a desirable advantage that the rotation velocity fluctuation of the photosensitive drum 3 is reliably avoided to form an electrostatic latent image on the surface with high quality while suppressing the consumption of the toner as much as possible.

If an interval between straight lines formed by the toner is increased excessively, there might be a moment that the cleaner blade 7*a* comes in sliding contact with the surface of the photosensitive drum 3 without toner. For this reason, it is necessary to turn on and off the exposing beam B for scanning over the photosensitive drum 3 at a proper interval. For example, in the embodiment, the emission of the exposing beam B by the exposer 5 is intermittently driven so as to irradiate for one rotation step of the photosensitive drum 3 and so as not to irradiate for nine rotation steps of the photosensitive drum 3.

Accordingly, it is possible to form, on the intermediate transfer belt 12, the toner image 35 to be the dummy image for being caused to uniformly come in pressure contact with a region on the surface of the photosensitive drum 3 with which the cleaner blade 7*a* comes in sliding contact during the exposure processing, with such a simple and easy structure that the exposer 5 simply turns on and off the exposing beam B for scanning over the photosensitive drum 3 in accordance with a driving control program. Consequently, it is possible to bring a state in which a part of the toner is reversely transferred and supplied onto the photosensitive drum 3 to be uniformly covered. Therefore, it is possible to reliably avoid the generation of a vibration on the photosensitive drum 3 during the exposure processing, thereby forming an electrostatic latent image with high precision.

In this embodiment, the exposing beam B emitted from the exposer 5 is turned on and off in accordance with the driving control program stored in the ROM 52 in advance, to form the toner image 35 to be the dummy image shown in FIG. 7. However, image data for forming the toner image 35 to be the dummy image may be stored in the ROM 52 in advance, in the same manner as the toner image 36 to be the actual image. In this case, it is not necessary to prepare a special driving control program.

Figure 16D:
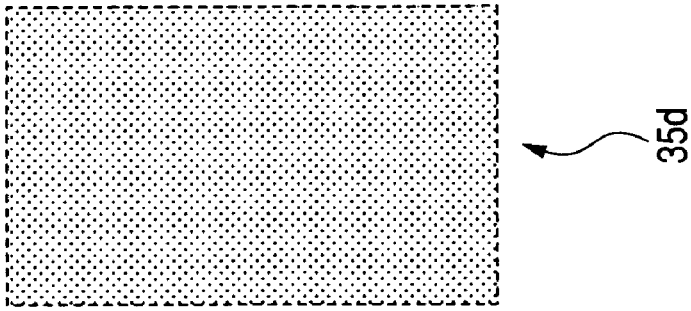
FIGS. 16A to 16D show another examples of the dummy image.
Figure 16C:
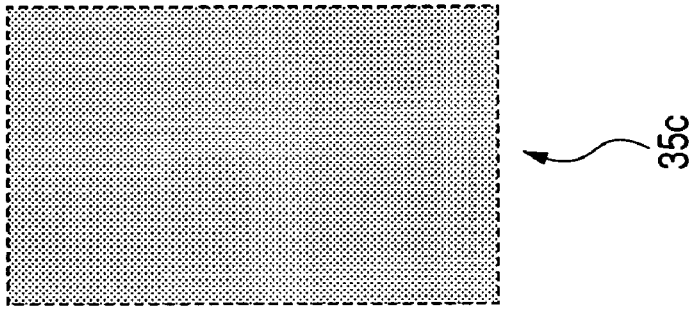
Figure 16B:
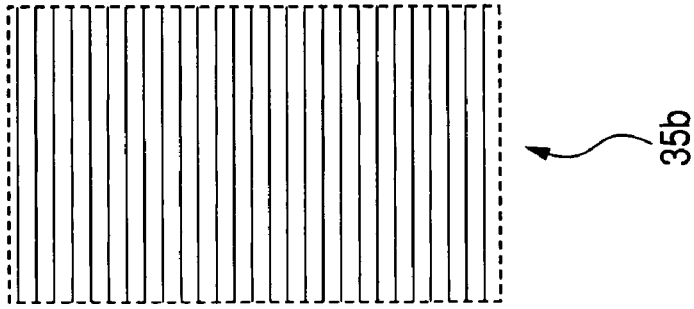
Figure 16A:
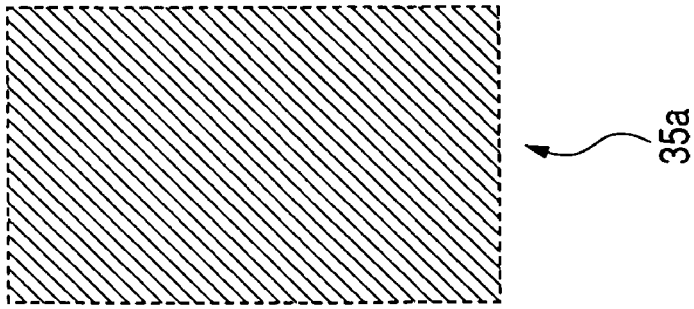

Furthermore, as shown in FIG. 16A, the dummy image may be a toner image 35*a* wherein a plurality of straight lines inclined with respect to the circulating direction of the intermediate transfer belt 12 (i.e., the rotating direction of the photosensitive drum 3; the lateral direction in this figure) are arrayed. In this case, the straight lines continuously come in contact with the cleaner blade 7*a* both in the primary scanning direction and the secondary scanning direction. Therefore, it is possible to substantially cause the toner to be present on the surface of the photosensitive drum 3 in a uniform covering state without interrupting the toner coming in contact with the cleaner blade 7*a*. As a result, the rotation velocity fluctuations of the photosensitive drum 3 can be reliably avoided, thereby forming an electrostatic latent image with high quality on a surface thereof.

As shown in FIG. 16B, the dummy image may be a toner image 35*b* wherein a plurality of straight lines extending in the secondary scanning direction are arrayed in the primary scanning direction. Also in this case, each of the straight lines continuously comes in contact with the cleaner blade 7*a*. Consequently, it is possible to substantially cause the toner to be present on the surface of the photosensitive drum 3 in a uniform covering state without interrupting the toner coming in contact with the cleaner blade 7*a*. As a result, the rotation velocity fluctuations of the photosensitive drum 3 can be reliably avoided, thereby forming an electrostatic latent image with high quality on a surface thereof.

As shown in FIG. 16C, the dummy image may be a toner image 35*c* wherein a halftone image (e.g., a light gray uniform image) irrespective of the rotating direction of the photosensitive drum 3. Also in this case, it is possible to substantially cause the toner to be present on the surface of the photosensitive drum 3 in a uniform covering state without interrupting the toner coming in contact with the cleaner blade 7*a*. As a result, the rotation velocity fluctuations of the photosensitive drum 3 can be reliably avoided, thereby forming an electrostatic latent image with high quality on a surface thereof. Although it is possible to form an uniform image with the highest density (i.e., a solid uniform image), the halftone image is preferable in view of the toner amount to be consumed.

As shown in FIG. 16D, the dummy image may be a toner image 35*d* wherein a halftone dot image irrespective of the rotating direction of the photosensitive drum 3. Also in this case, it is possible to substantially cause the toner to be present on the surface of the photosensitive drum 3 in a uniform covering state without interrupting the toner coming in contact with the cleaner blade 7*a*. As a result, the rotation velocity fluctuations of the photosensitive drum 3 can be reliably avoided, thereby forming an electrostatic latent image with high quality on a surface thereof. The halftone image shown in FIG. 16C may be applicable as a background of the half tone dot image.

The above toner images 35*a* to 35*d* may be formed in accordance with the control program of the exposer 5 in the same manner as in the case of FIG. 7. However, image data for forming the toner images 35*a* to 35*d* to be the dummy images may be stored in the ROM 52 in advance, in the same manner as the toner image 36 to be the actual image, because the on and off operations of the exposing beam B are often carried out so that a control becomes complicated.

The control for replenishing toner on the photosensitive drum 3 from the intermediate transfer belt 12 will now be described in more detail with reference to FIGS. 8 through 15.

Figure 8:
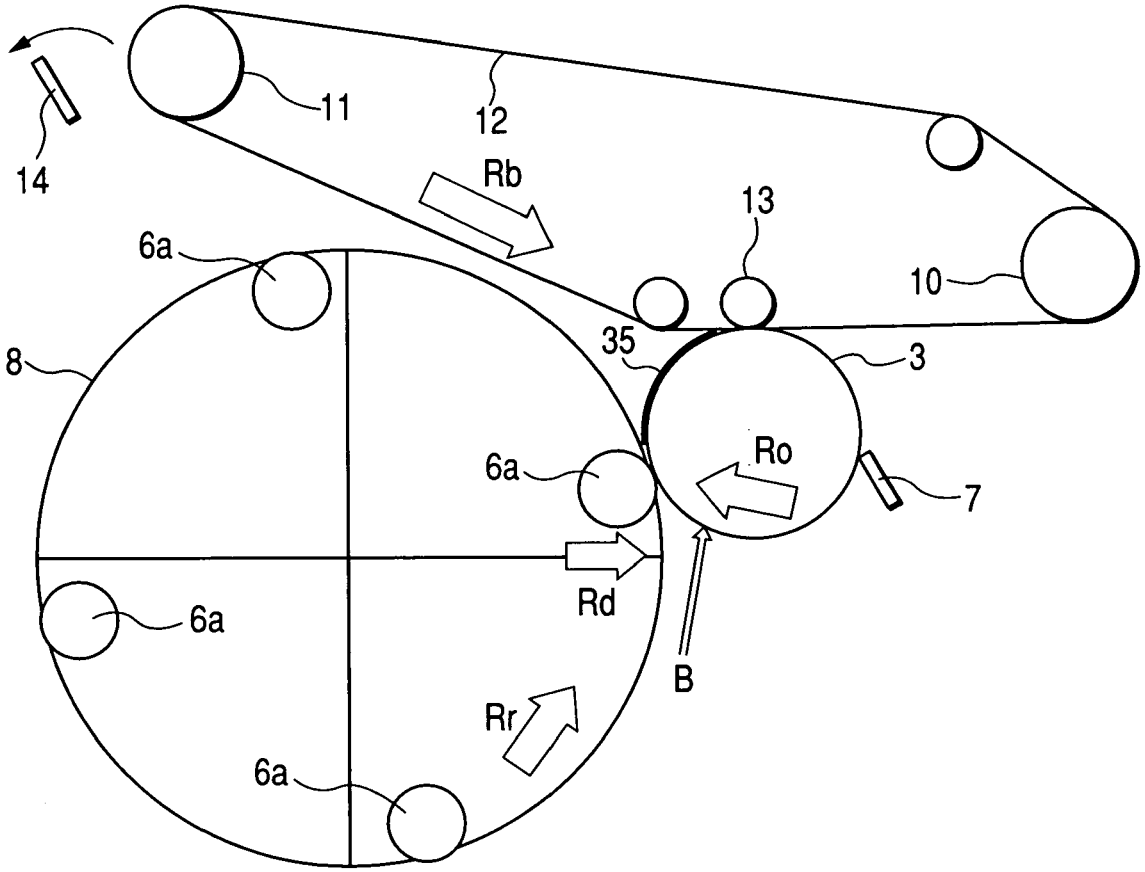
FIG. 8 is a schematic side view showing a state that the dummy image formation is performed.

In this embodiment, prior to the image forming operation, the photosensitive drum 3, the developing roller 6*a* of the rotary development unit 8, and the intermediate transfer belt 12 are driven to rotate in the directions Ro, Rd, and Rb, respectively, and the outer circumferential surface of the photosensitive drum 3 is thereby charged uniformly by the charger 4. Subsequently, as shown in FIG. 8, the dummy image is exposed on the surface of the photosensitive drum 3 by the exposer 5 to form an electrostatic latent image. In this instance, the rotary development unit 8 moves by rotation in the direction Rr such that the developing roller 6*a* of the toner cartridge 6 abuts on the photosensitive drum 3. A dummy image 35 is thus formed on the photosensitive drum 3.

Figure 9:
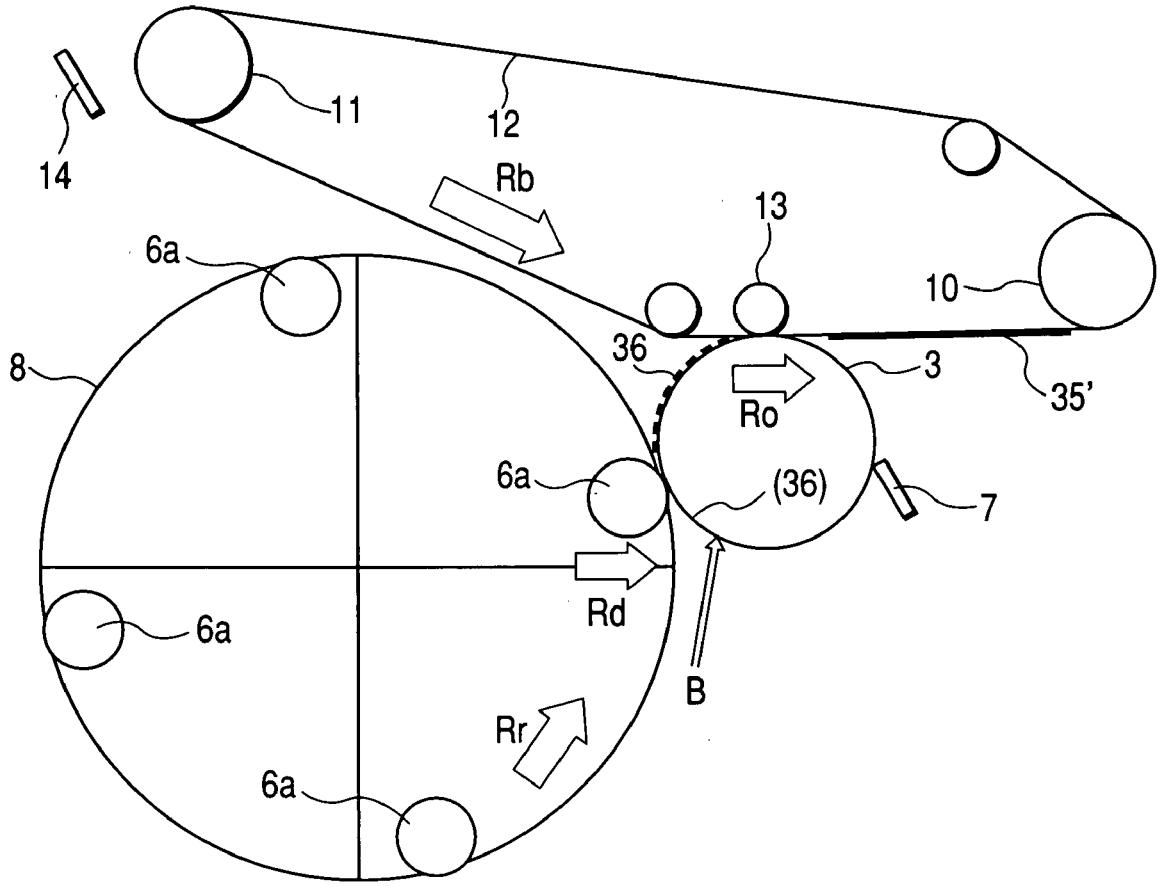
FIG. 9 is a schematic side view showing a state that a toner image of the first color is developed.

As is shown in FIG. 9, the dummy image 35 formed on the photosensitive drum 3 is transferred onto the intermediate transfer belt 12 from the photosensitive drum 3 as a toner image 35' by the primary transfer roller 13 to which the primary transfer voltage of a polarity opposite to the toner charging polarity is being applied. The exposure and the development for a toner image 36 to be subjected to the primary transfer is then performed.

Figure 10:
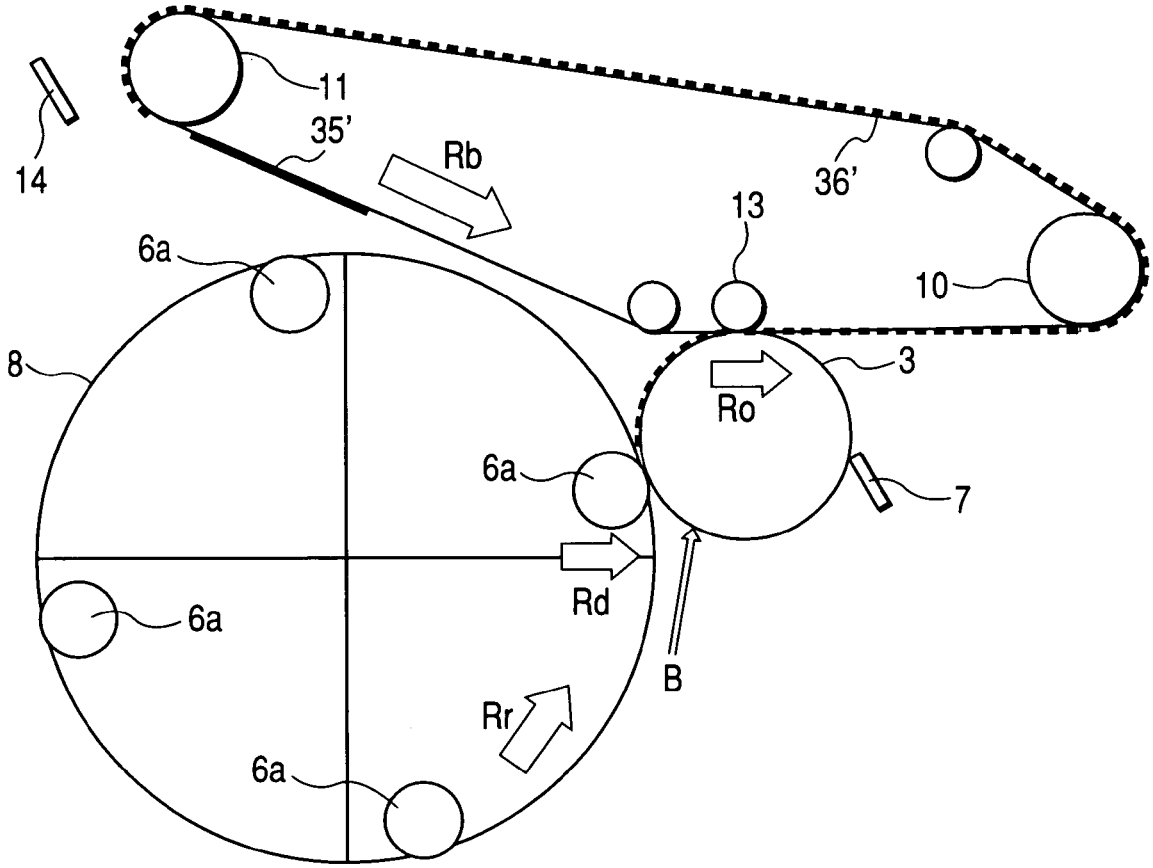
FIG. 10 is a schematic side view showing a state that the toner image of the first color is primarily transferred onto an intermediate transfer belt.

Since the belt cleaner 14 and the secondary transfer roller 15 are kept spaced apart from the intermediate transfer belt 12, when the toner image 36 of the first color has been formed on the photosensitive drum 3, the dummy image 35' on the intermediate transfer belt 12 approaches the primary transfer point as shown in FIG. 10.

Figure 11:
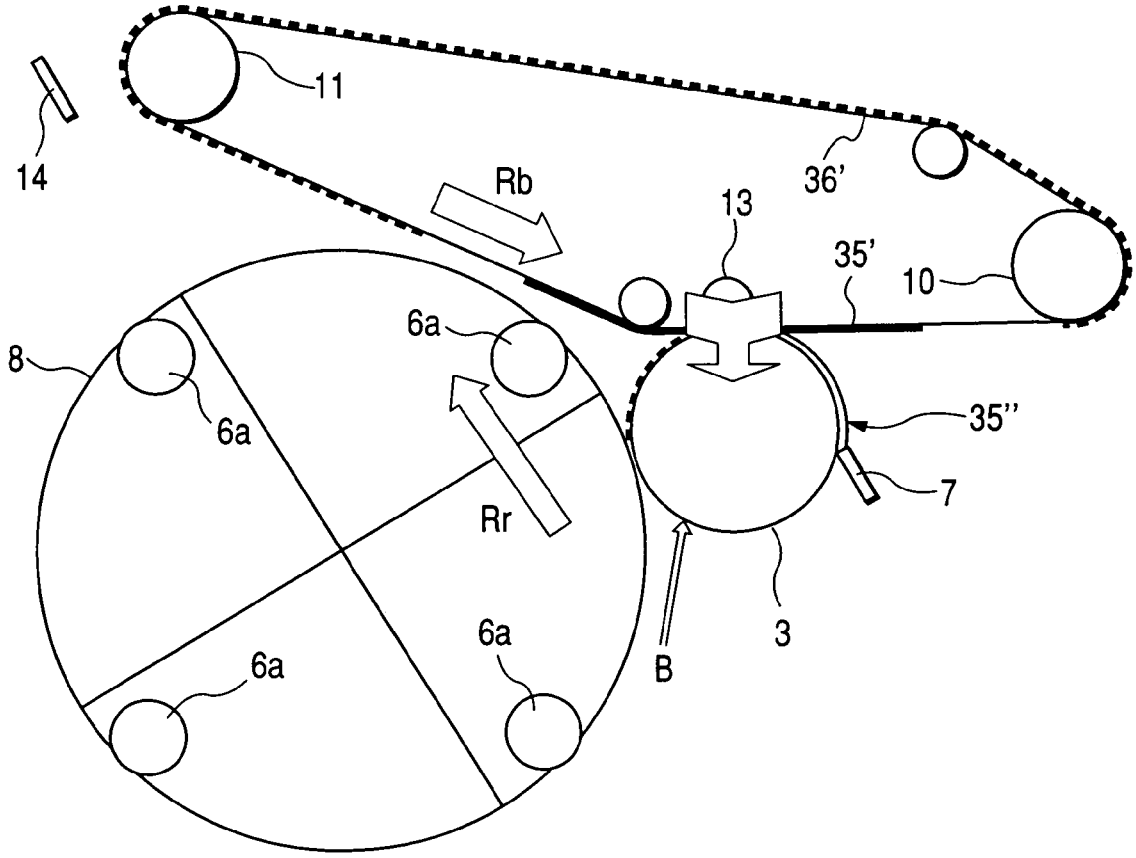
FIG. 11 is a schematic side view showing a state that the dummy image is reversely transferred onto the photosensitive drum during the development color switching.

In order to perform the image formation of the second color, the color switching operation of the rotary development unit 8 is performed. Then, as shown in FIG. 11, the development rotary unit 8 moves by rotation in the direction Rr, so that the developing roller 6*a* is spaced apart from the photosensitive drum 3. The dummy image 35', which has been transferred onto the intermediate transfer belt 12 in advance, reaches the primary transfer point and is then transferred reversely onto the photosensitive drum 3 as a toner image 35". Due to this reverse transfer, toner is replenished on the photosensitive drum 3 at the primary transfer point even when the developing roller 6*a* is kept spaced apart from the photosensitive drum 3, and is thereby supplied to the abutting portion to the cleaner 7 as the lubricant.

Figure 12:
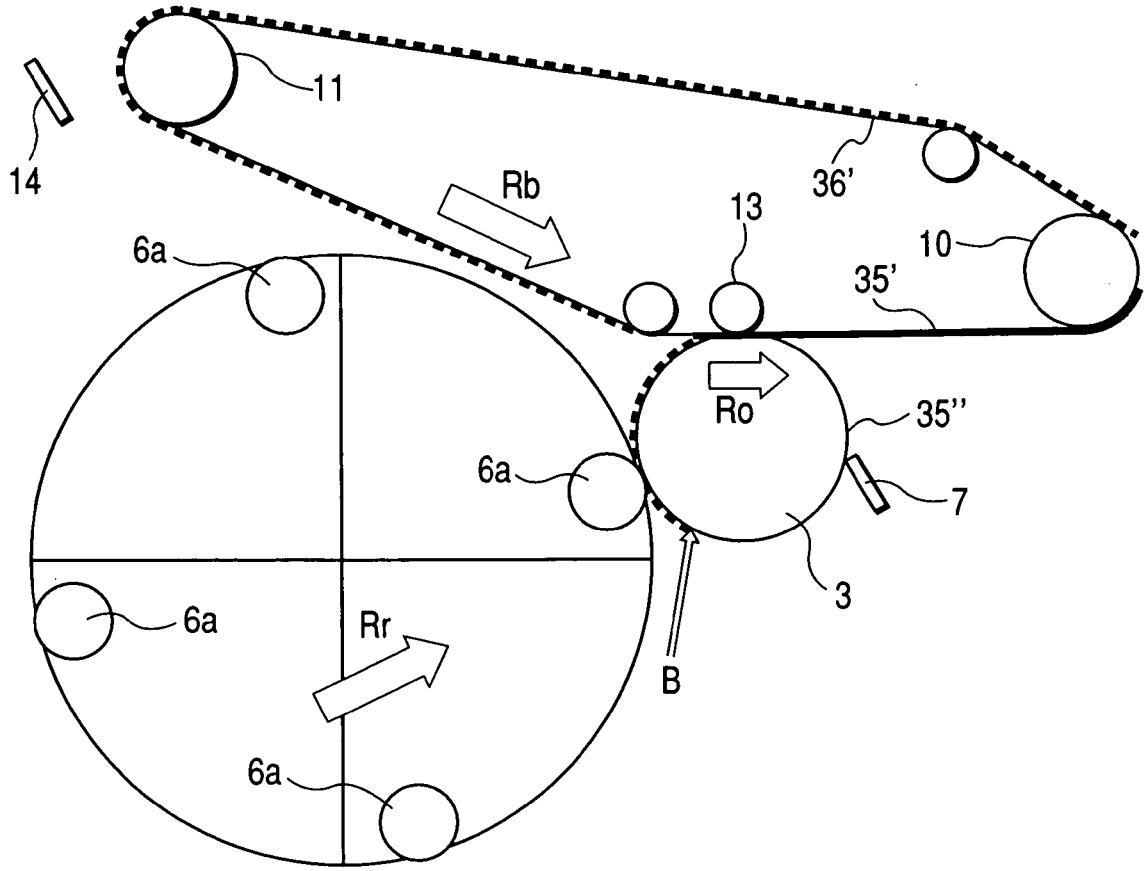
FIG. 12 is a schematic side view showing a state that a toner image of the second color is developed.
Figure 13:
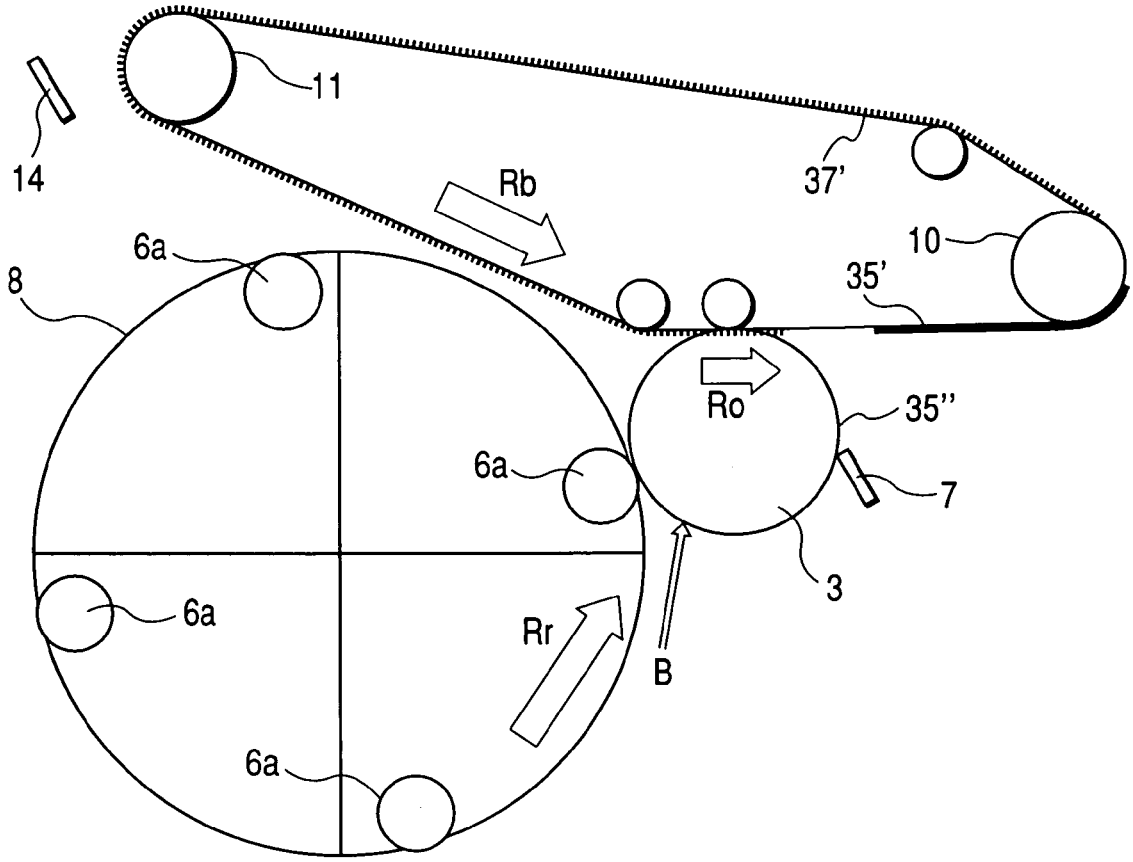
FIG. 13 is a schematic side view showing a state that a toner image of the final color is developed.
Figure 14:
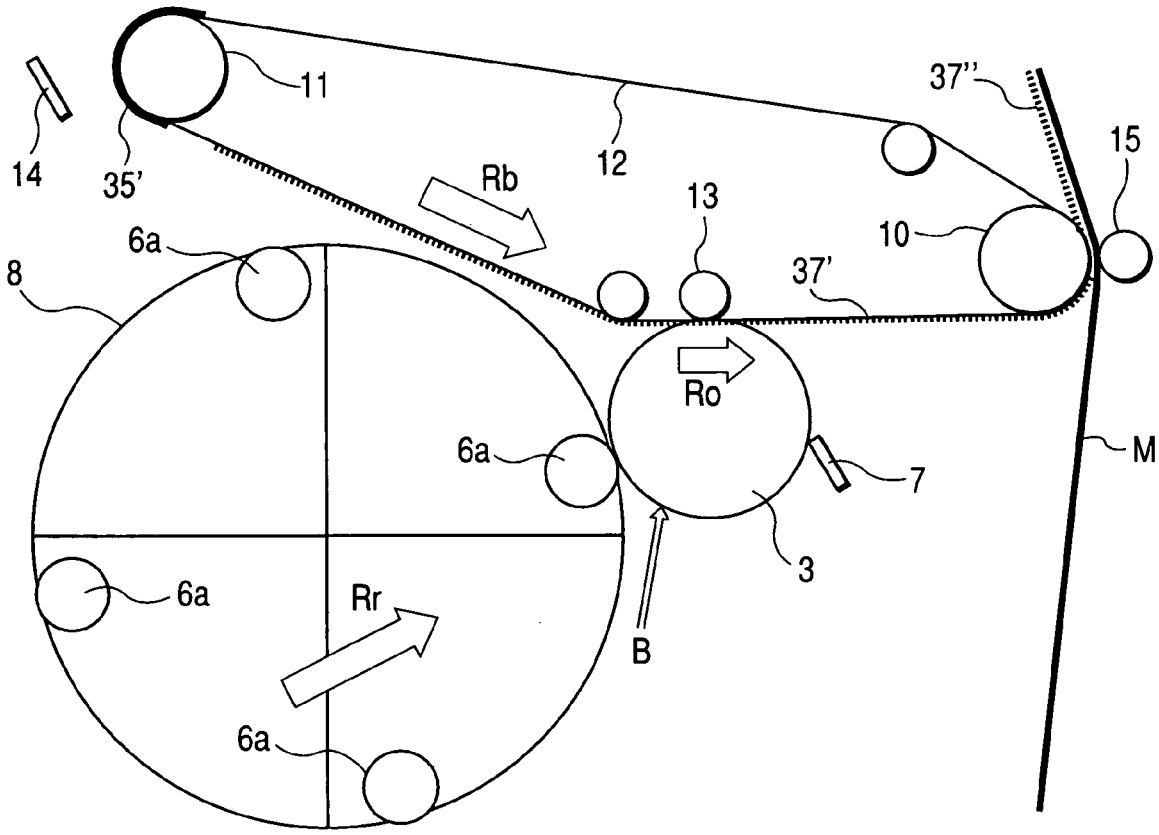
FIG. 14 is a schematic side view showing a state that a full color toner image is secondary transferred onto a recording medium.
Figure 15:
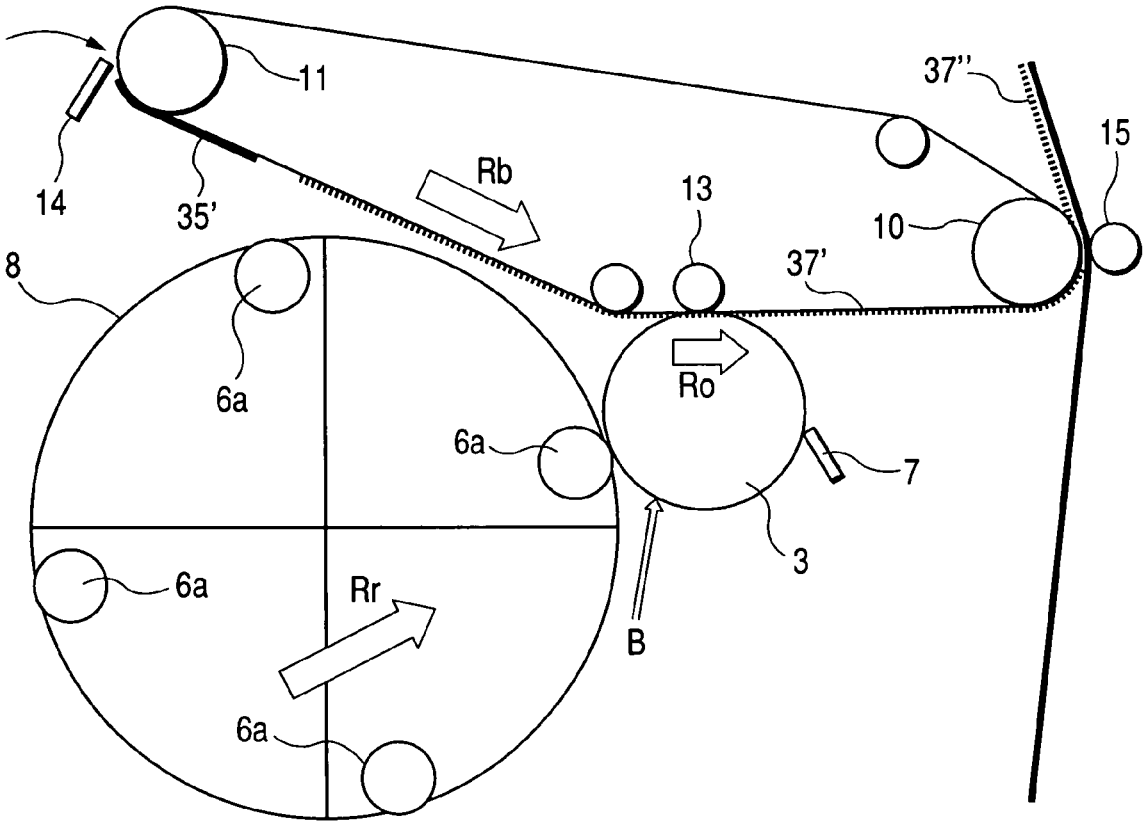
FIG. 15 is a schematic side view showing a state that a cleaning operation is performed with respect to the intermediate transfer belt.

Likewise, when the image formation of the second color is started, as shown in FIG. 12, at a time point where the exposer 5 exposes the photosensitive drum 3 by an exposing beam B, the toner image 35", which has been reversely transferred from the intermediate transfer belt 12 and replenished on the photosensitive drum 3 as the lubricant, is supplied to the abutting portion of the cleaner 7. It is thus possible to maintain stable rotations of the photosensitive drum 3. Thereafter, the image forming operation of the third color is performed in the same manner.

Figure 17:
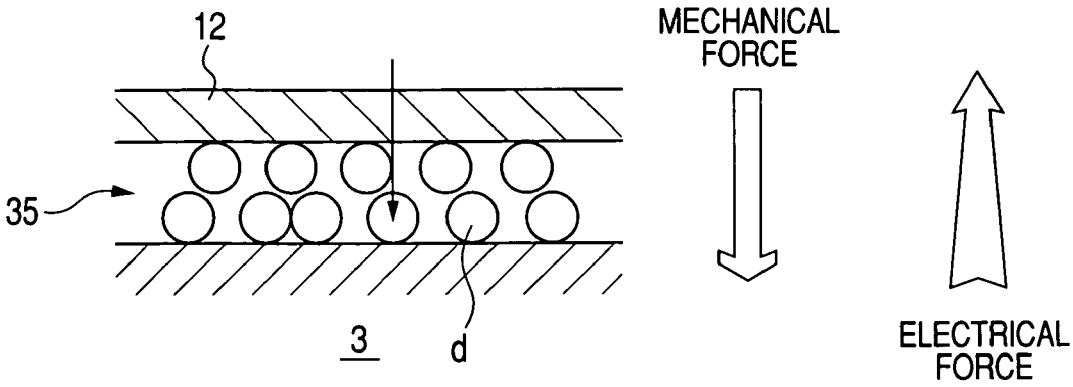
FIG. 17 is a diagram for explaining forces applied to the dummy image.

The dummy image 35 is pressed by the primary transfer roller 13 through the intermediate transfer belt 12 and is thus caused to come in pressure contact with the surface of the photosensitive drum 3. Incidentally, since a primary transfer bias (electrical force) is applied from the photosensitive drum 3 onto the intermediate transfer belt 12 as shown in FIG. 17, most of the toner d remains on the intermediate transfer belt 12, while a part of the toner d coming in pressure contact with the surface of the photosensitive drum 3 is reversely transferred and supplied by a mechanical peeling force (a physical sticking force).

Figure 18A:
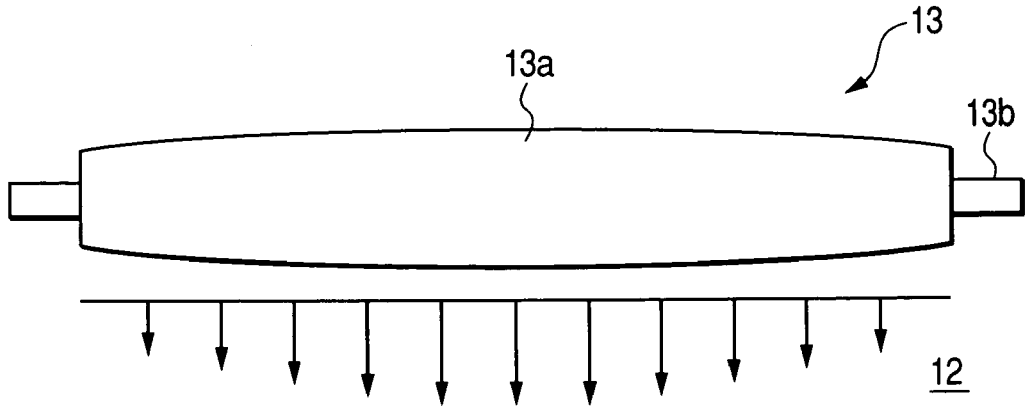
FIGS. 18A and 18B are diagrams for explaining forces applied from a primary transfer roller to the photosensitive drum through the intermediate transfer belt in the image forming apparatus of the invention.

As shown in FIG. 18A, the primary transfer roller 13 is constituted by a roller portion 13*a* for coming in pressure contact with the surface of the intermediate transfer belt 12 and a rotary shaft 13*b* penetrating through the axial core of the roller portion 13*a*, both ends of which are to be rotatably supported. The roller portion 13*a* is configured as to have a crown shape wherein an axial center portion thereof has a larger diameter than that of axial end portions thereof.

Figure 19A:
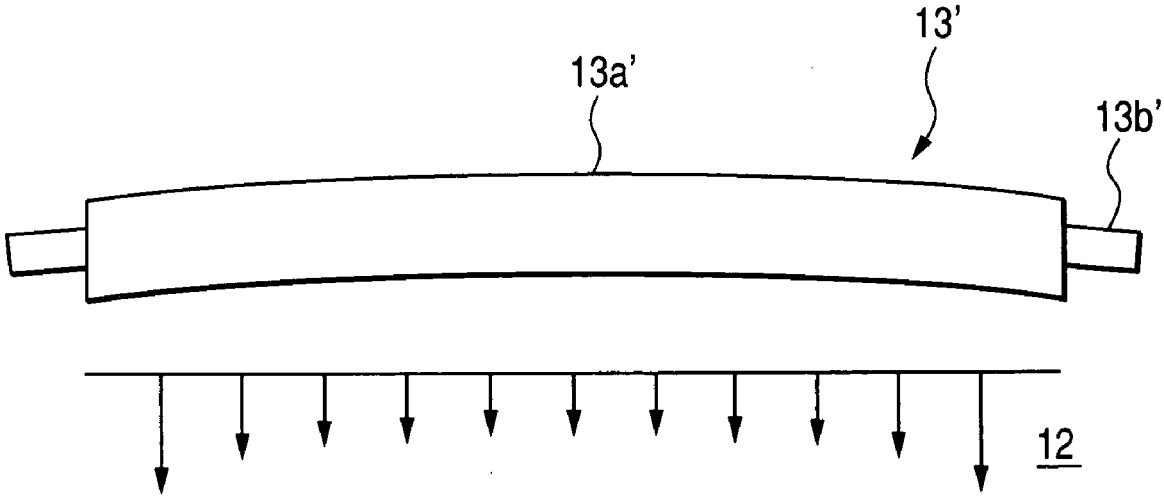
FIGS. 19A and 19B are diagrams for explaining forces applied from a primary transfer roller to a photosensitive drum through an intermediate transfer belt in an image forming apparatus of a comparative example.
Figure 19B:
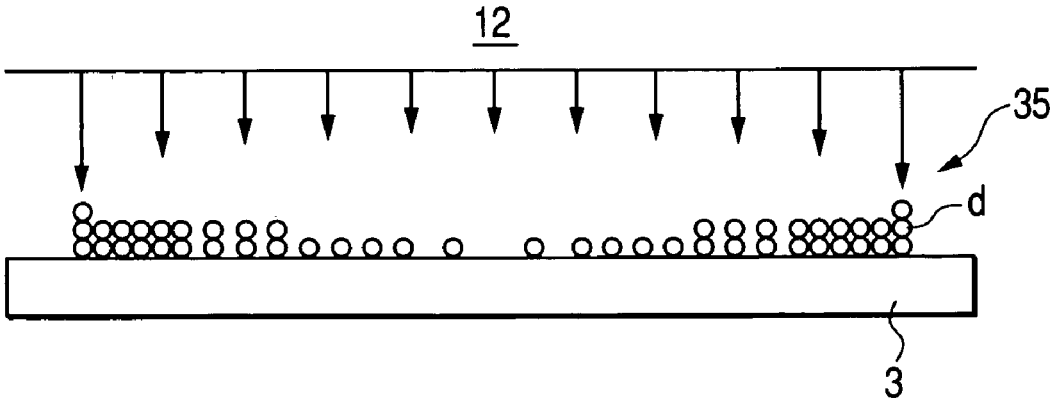

Since a roller portion 13*a'* of a typical primary transfer roller 16' is configured to have an identical diameter entirely for the axial direction thereof, when the pressure is applied to both ends of a rotary shaft 13*b'* so as to press the intermediate transfer belt 13 against the surface of the photosensitive drum 3, an axial center portion of the roller portion 13*a'* is deviated from the intermediate transfer belt 12 (the photosensitive drum 3) as shown in FIG. 19A. As a result, the roller portion 13*a'* cannot uniformly press the intermediate transfer belt 12 in the axial direction to cause the dummy image 35 to come in pressure contact with the surface of the photosensitive drum 3 as shown in FIG. 19B, so that the toner b cannot be transferred reversely so as to be distributed uniformly.

Figure 18B:
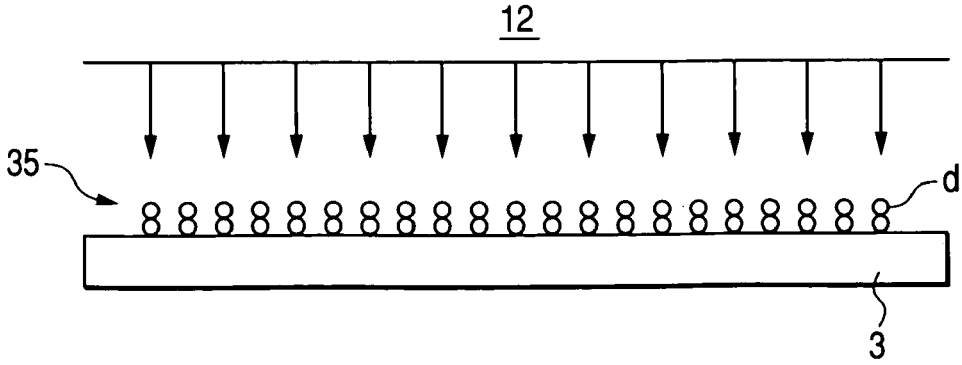

However, in this embodiment, since the roller portion 13*a* of the primary transfer roller 13 has the crown shape as described the above, the intermediate transfer belt 12 can be pressed at uniform pressure as shown in FIG. 18B so that the dummy image 35 on the intermediate transfer belt 12 can be caused to uniformly come in pressure contact with the surface of the photosensitive drum 3 and can be thus transferred reversely thereto.

Since the transferred toner is uniformly distributed on the surface of the photosensitive drum 3, it is possible to reliably avoid the generation of the vibration on the photosensitive drum 3 during the exposure processing with the above-described simple structure, thereby forming an electrostatic latent image with high precision.

FIG. 18A shows the curvature of the outer periphery of the roller portion 13*a* exaggeratedly to explain the advantage of this configuration. However, the flexed amount of the primary transfer roller 13 is actually very small. Consequently, it is sufficient that the diameter is changed corresponding to the amount of the flexure. For example, a change in a micron order is enough in some cases.

In the embodiment, the toner image to be the dummy image is reversely transferred from the intermediate transfer belt 12 onto the photosensitive drum 3 in a state where an ordinary transfer bias to be applied for forming an output image is applied. In this case, if the photosensitive drum 3 is uniformly charged to −600 V and an ordinary transfer bias of 200 to 300 V is applied in the primary transfer portion, for example, a potential difference of 800 to 900 V is made. Since the reverse transfer can be promoted if the potential difference is small, the transfer bias applied to the region where the dummy image is reversely transferred may be reduced to be lower than the ordinary transfer bias, or may be a transfer bias having an inversed polarity, in accordance with the toner amount for the dummy image (the density of the toner image), the pattern of the dummy image, the contact pressure generated between the intermediate transfer belt 12 and the photosensitive drum 3 or the like. Such cases will be described below.

Figure 20:
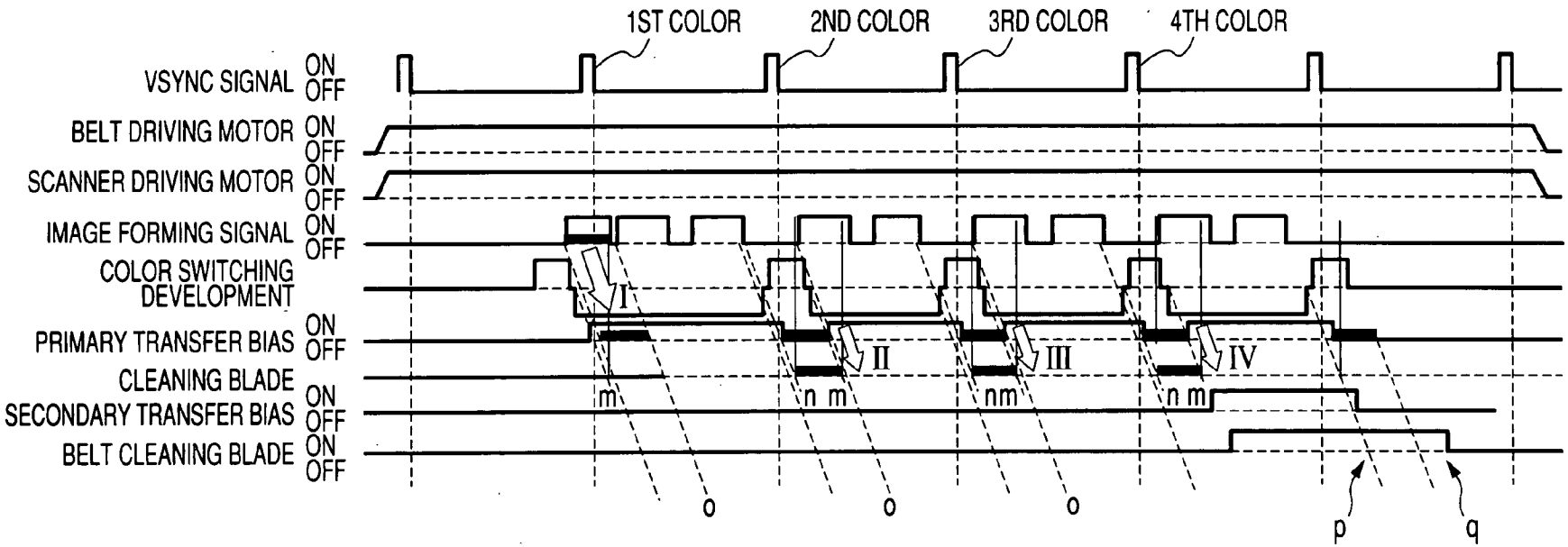
FIG. 20 is a diagram for explaining a dummy image formation according to a second embodiment of the invention.

FIG. 20 shows a second embodiment of the invention. As well as the first embodiment, a dummy image is formed on the photosensitive drum 3 prior to the formation of the actual image for the first color, and the dummy image is transferred onto the intermediate transfer belt 12 by the application of a primary transfer bias at the primary transfer portion. In this embodiment, the primary transfer bias is lowered at the timings that the dummy image is reversely transferred from the intermediate transfer belt 12 to the photosensitive drum 3 prior to the exposure for each of the second to fourth colors. As a result, the dummy image is reversely transferred with appropriate toner amount (density).

Specifically, the transfer bias is lowered by 100 V, thereby lowering the potential difference with respect to the photosensitive drum 3 to 700-800 V.

Figure 21:
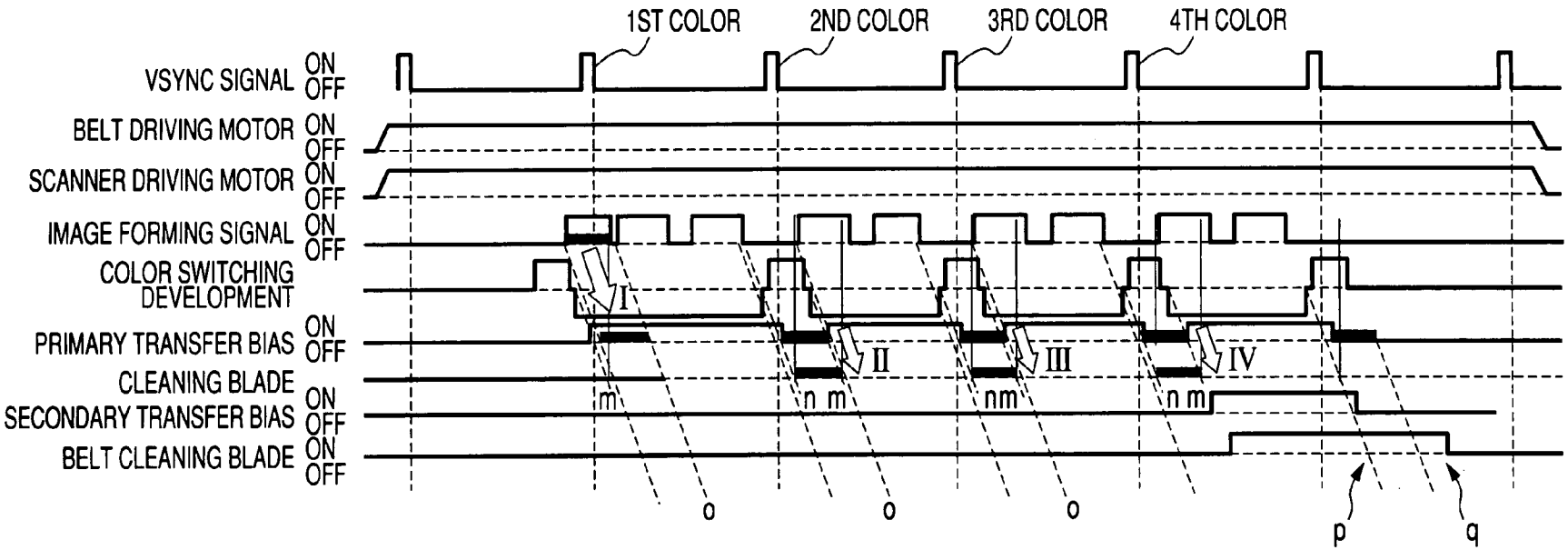
FIG. 21 is a diagram for explaining a dummy image formation according to a third embodiment of the invention.

FIG. 21 shows a third embodiment of the invention wherein the primary transfer bias is turned off at the timings that the dummy image is reversely transferred from the intermediate transfer belt 12 to the photosensitive drum 3 prior to the exposure for each of the second to fourth colors. In this case the potential difference is lowered to 600V.

Figure 22:
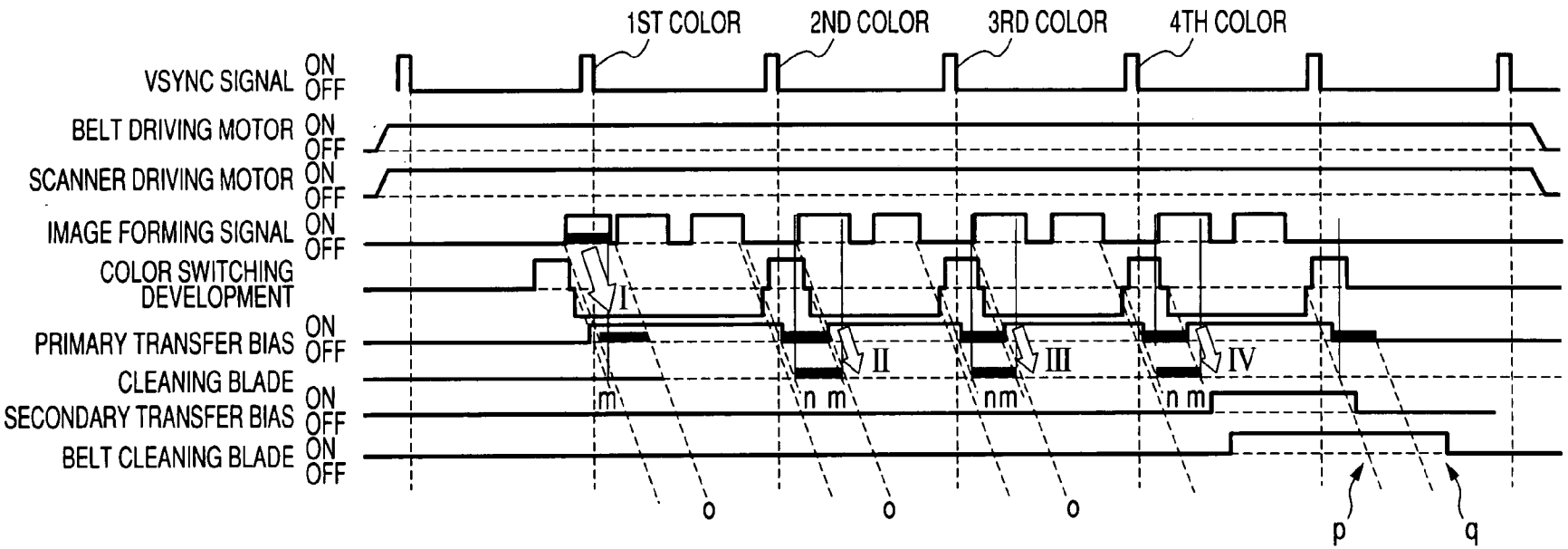
FIG. 22 is a diagram for explaining a dummy image formation according to a fourth embodiment of the invention.

FIG. 22 shows a fourth embodiment of the invention wherein a transfer bias having an inversed polarity is applied at the timings that the dummy image is reversely transferred from the intermediate transfer belt 12 to the photosensitive drum 3 prior to the exposure for each of the second to fourth colors. In this case, the applied transfer bias is −200 V so that the potential difference is lowered to 400 V.

Figure 23:
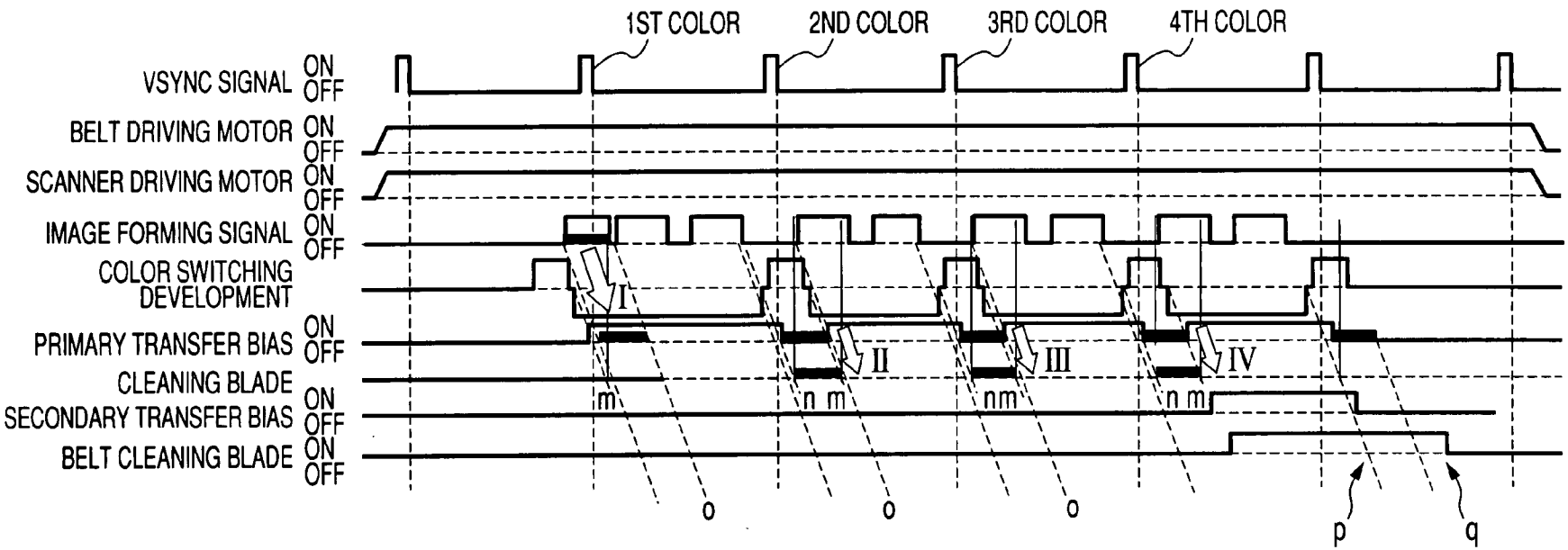
FIG. 23 is a diagram for explaining a dummy image formation according to a fifth embodiment of the invention.

FIG. 23 shows a fifth embodiment of the invention. In this embodiment, in order to obtain the same condition that the potential difference between the charged surface of the photosensitive drum 3 and the primary transfer bias is lowered, the photosensitive drum 3 is exposed to change the surface potential thereof, instead of the change in the primary transfer bias. Specifically, the surface potential of the photosensitive drum 3 is changed from −600 V to −50 V by the exposure, in order to promote the reverse transfer of the dummy image.

When the image formation is completed, the cleaner blade 14*a* is caused to abut on the intermediate transfer belt 12 until a timing "q" shown in FIG. 4, so that the dummy image formed on the intermediate transfer belt 12 is removed together with the residual toner of the actual image which has been subjected to the secondary transfer. In a case where a next image is continuously formed, the cleaner blade 14*a* is caused to abut on the intermediate transfer belt 12 until a timing "p" shown in FIG. 4, so that only the residual toner is removed while remaining the dummy image. Accordingly, the toner of the dummy image is kept being reversely and repetitively transferred from the intermediate transfer belt 12 to the photosensitive drum 3 for a prescribed number of times of image formations (e.g., 20 sheets). In a case where the image formation is finished before reaching the prescribed number of times, the dummy image formed on the intermediate transfer belt 12 may be immediately cleaned as shown in FIG. 4. Alternatively, a timer may be operated to count a prescribed time period, so that the dummy image is removed by the cleaner blade 14*a* after the elapse of the prescribed time period.

There will be specifically described a case where the image formation for next two pages is performed while maintaining the dummy image on the intermediate transfer belt 12 which has been used for the image formation for previous two pages shown in FIG. 4.

Figure 24:
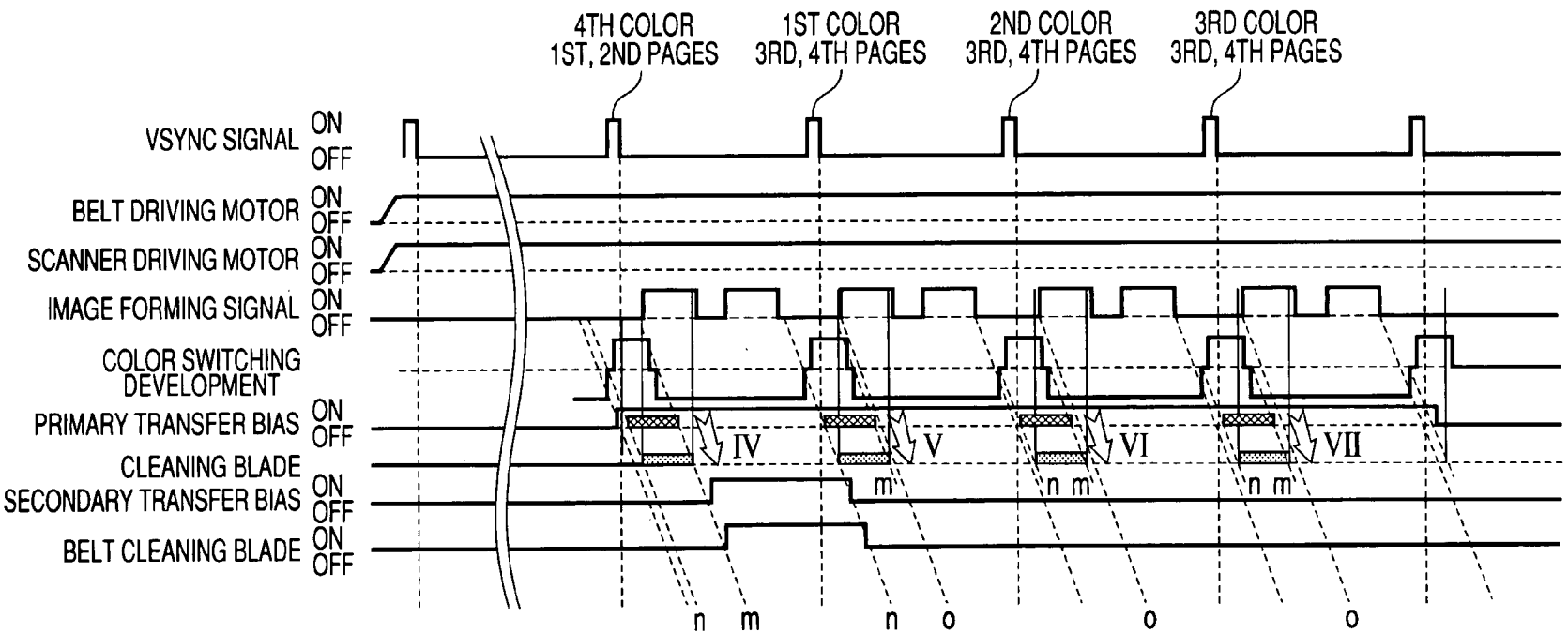
FIG. 24 is a diagram for explaining a control sequence in a case where an image formation for next pages is performed without removing the dummy image.

As shown in FIG. 24, the image formation of the fourth color for the first and second pages is started, the secondary transfer bias is applied to transfer the output image is transferred from the intermediate transfer belt 12 to a recording medium. Incidentally, the cleaner blade 14*a* is brought into contact with the intermediate transfer belt 12 to remove the residual toner for the output image. The cleaner blade 14*a* is separated from the intermediate transfer belt 12 before the dummy image reaches the contact position of the cleaner blade 14*a*. After then, the dummy image is reversely transferred from the intermediate transfer belt 12 to the photoconductive drum 3 at the timings as explained in the case of FIG. 4 (indicated by arrows V, VI and VII).

There will be specifically described a case where a dummy image is formed on the intermediate transfer belt 12 every time when (N+1) pages of image formations are completed.

Figure 25:
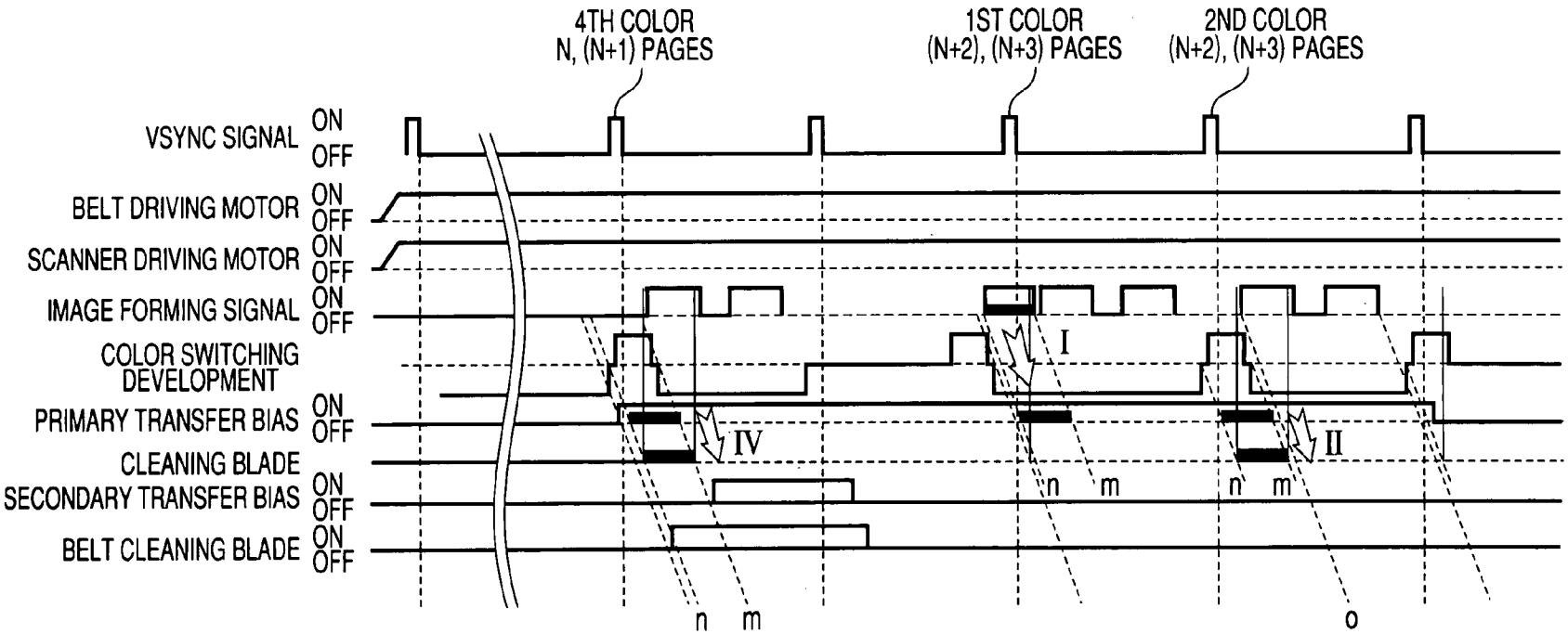
FIG. 25 is a diagram for explaining a control sequence in a case where an image formation for next pages is performed after a new dummy image is formed.

As shown in FIG. 25, the image formation of the fourth color for the N-th and (N+1)th pages is started, the secondary transfer bias is applied to transfer the output image is transferred from the intermediate transfer belt 12 to a recording medium. Incidentally, the cleaner blade 14*a* is brought into contact with the intermediate transfer belt 12 to remove the residual toner for the output image. The dummy image passing the secondary transfer position is also removed by the cleaner blade 14*a*.

In response to next one of the vsync signal, the color switching operation is hastily performed to place the first color for the development of images for the (N+2)th and (N+3)th pages at the development position. A dummy image is then formed and developed on the photosensitive drum 3, and transferred onto the intermediate transfer belt 12 prior to the image formation for the (N+2)th and (N+3)th pages as explained in the case of FIG. 4.

As shown in FIGS. 4 and 25, the removal of the dummy image may be before or after the removal of the residual toner for the output image.

The reverse transfer of the dummy image (reverse toner supply) to the photosensitive drum 3 is necessary in a case where the cleaner blade 7*a* comes in slide contact with a clean region on the photosensitive drum 3 from which the residual toner for the developed image has been already removed, during the exposure processing. In other words, since the cleaner blade 7*a* comes in contact with the region provided with toner during the exposure processing for the first color (the toner was supplied from the developing roller 6*a*), the reverse transfer is not necessary. That is, the necessity of the dummy image is determined based on the fact whether the color switching operation of the rotary development unit 8 can be finished before the exposure processing for the first page of the next color is started.

Figure 26:
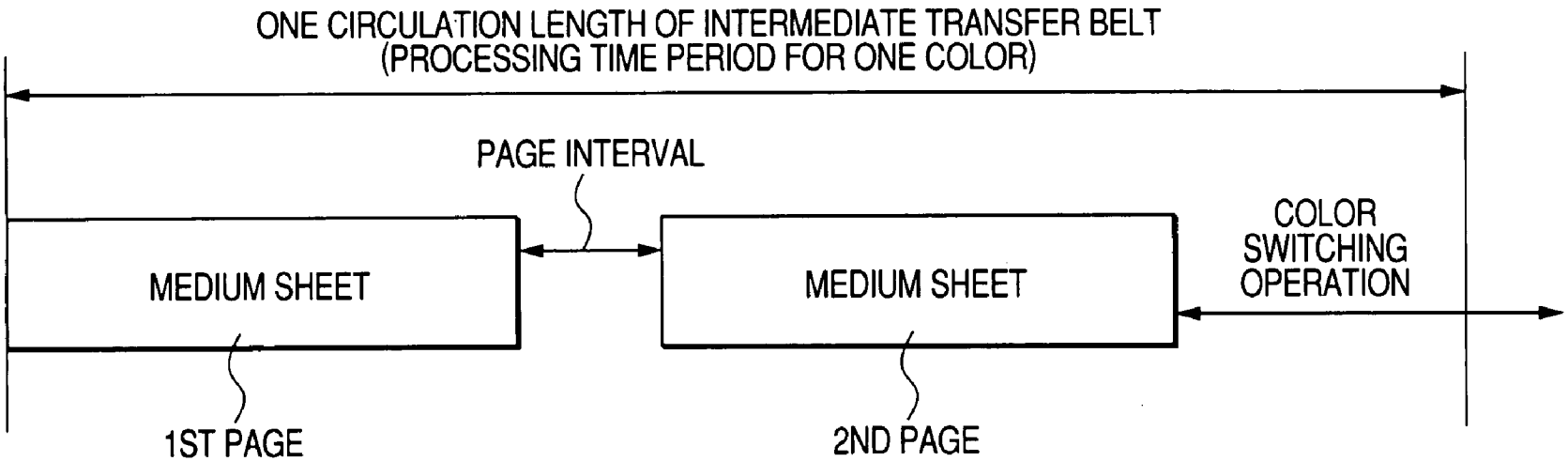
FIG. 26 is a diagram for explaining the necessity of the dummy image formation in a case where the image formation for two pages of medium sheets is performed.
Figure 27:
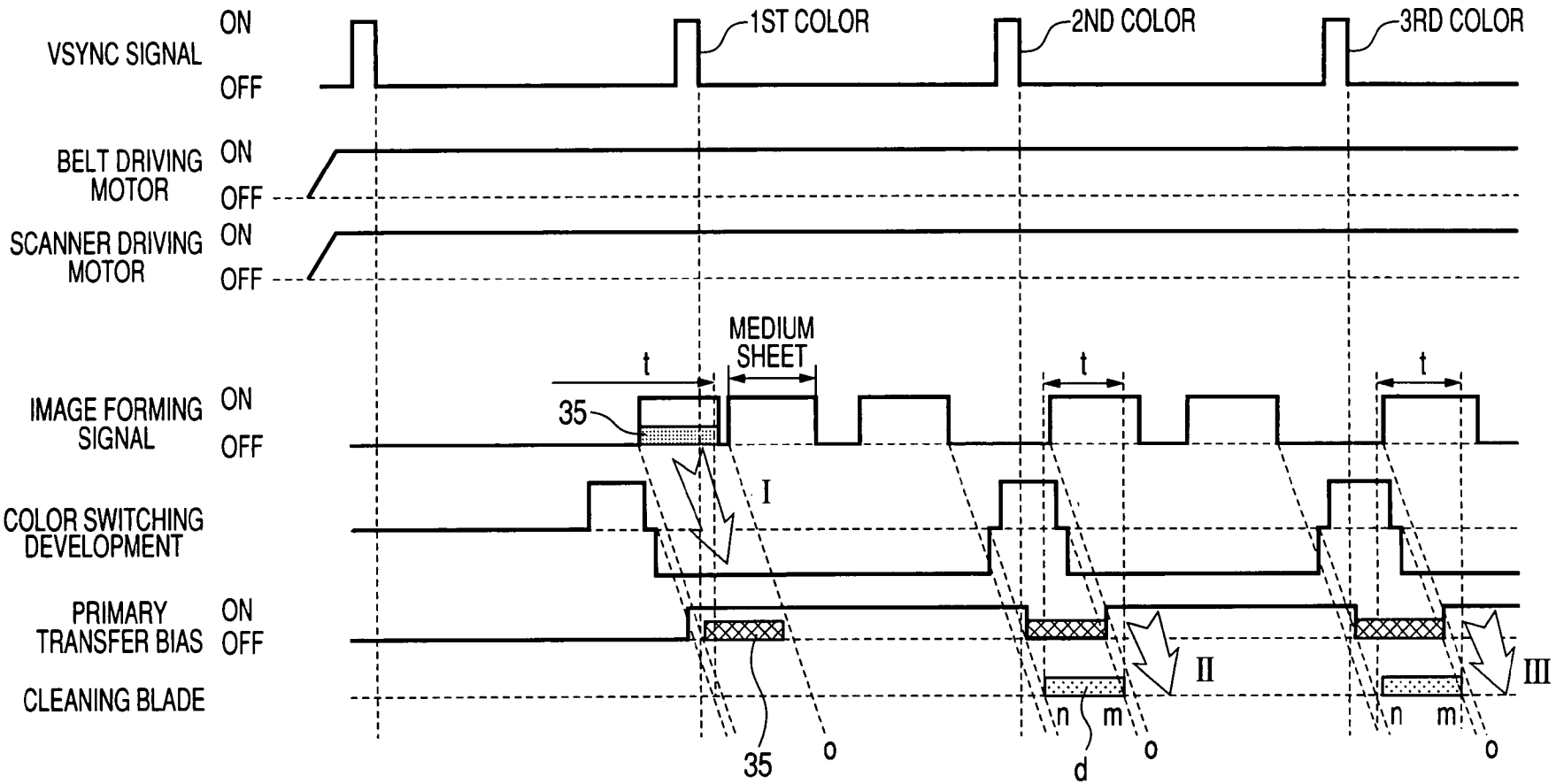
FIG. 27 is a diagram for explaining a control sequence for the case shown in FIG. 26.

For example, as shown in FIG. 26, the timings of the exposure processing are determined within a time period corresponding to one circulation cycle of the intermediate transfer belt 12. In a case where the image formation is performed for two pages of medium sheets (e.g., A4 size, letter size), the color switching operation of the rotary development unit 8 cannot be finished before the exposure processing for the next color is started (i.e., during one circulation of the intermediate transfer belt 12), after the exposure for the second page is finished. Hereinafter, the description is based on the assumption that the image size matches with the full size of the recording medium of interest. Accordingly, the CPU 51 of the engine controller 50 decides that the reverse supply of the toner d from the dummy image 35 is necessary, thereby executing the process for forming the dummy image 35 as shown in FIG. 27.

Figure 28:
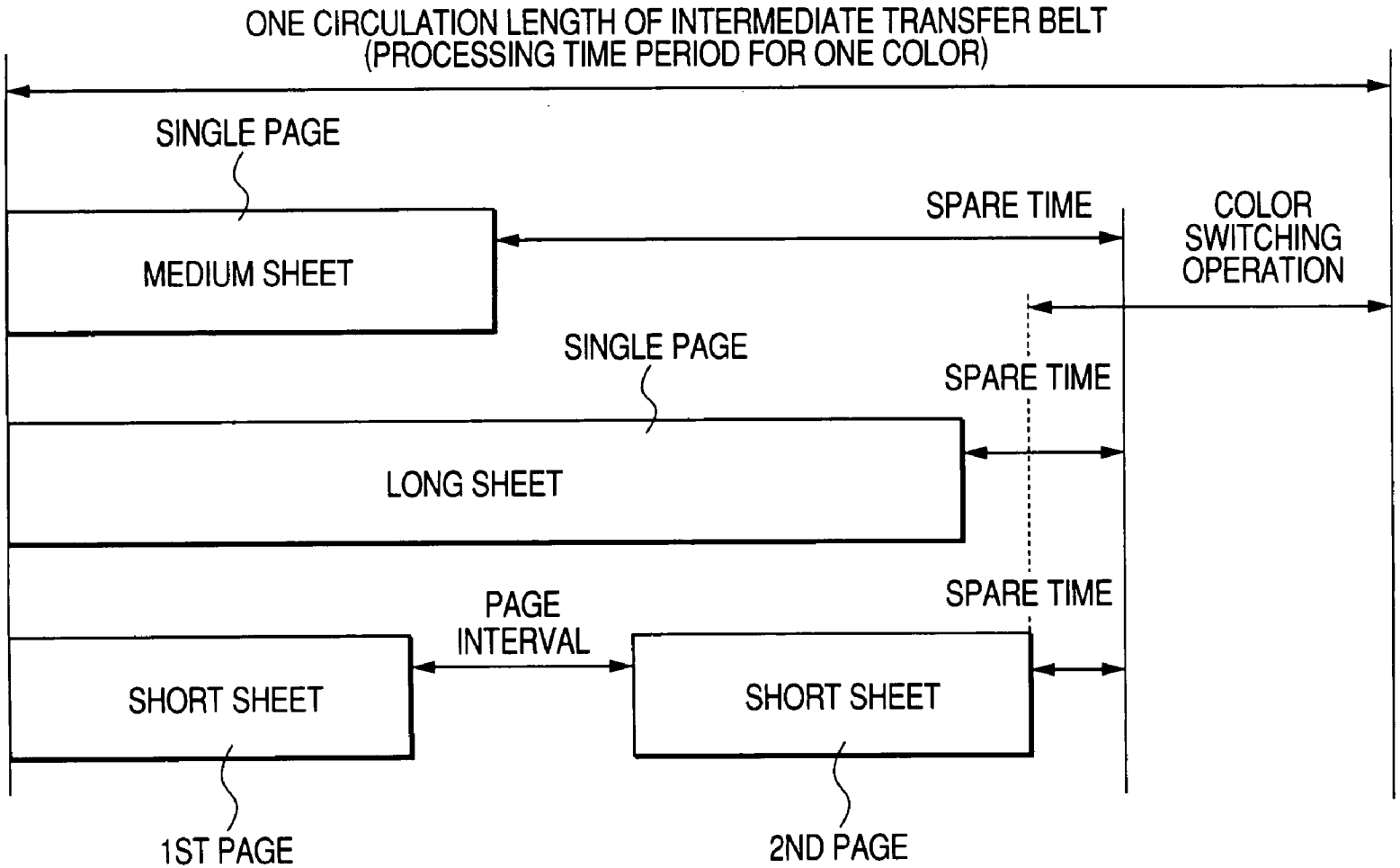
FIG. 28 is a diagram for explaining cases in which the dummy image formation is not necessary.
Figure 29:
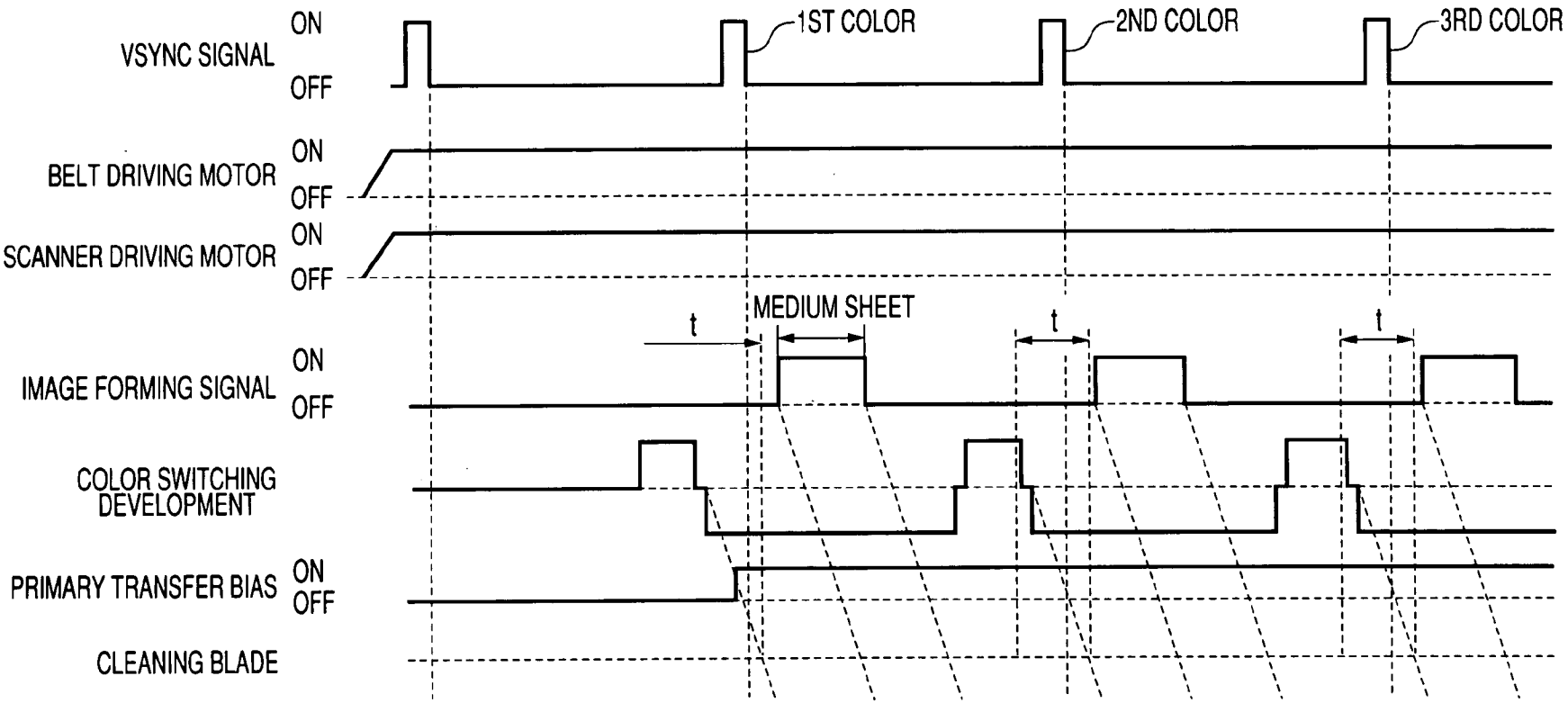
FIGS. 29 to 31 are diagrams for explaining control sequences for the cases shown in FIG. 28.

The length of the intermediate transfer belt 12 is so designed that two pages of image data for the medium sheet can be formed thereon. For this reason, in a case where the image formation is performed for a single page of image data for the medium sheet, there is a spare time period for performing the color switching operation as shown in FIG. 28. Accordingly, the start timing of the color switching operation is brought forward as shown in FIG. 29, so that the time period t in which the rotation velocity fluctuation of the photosensitive drum 3 tends to be occurred can be finished before the exposure processing for the next color is started. Accordingly, an electrostatic latent image for the next color can be formed stably and accurately.

Figure 30:
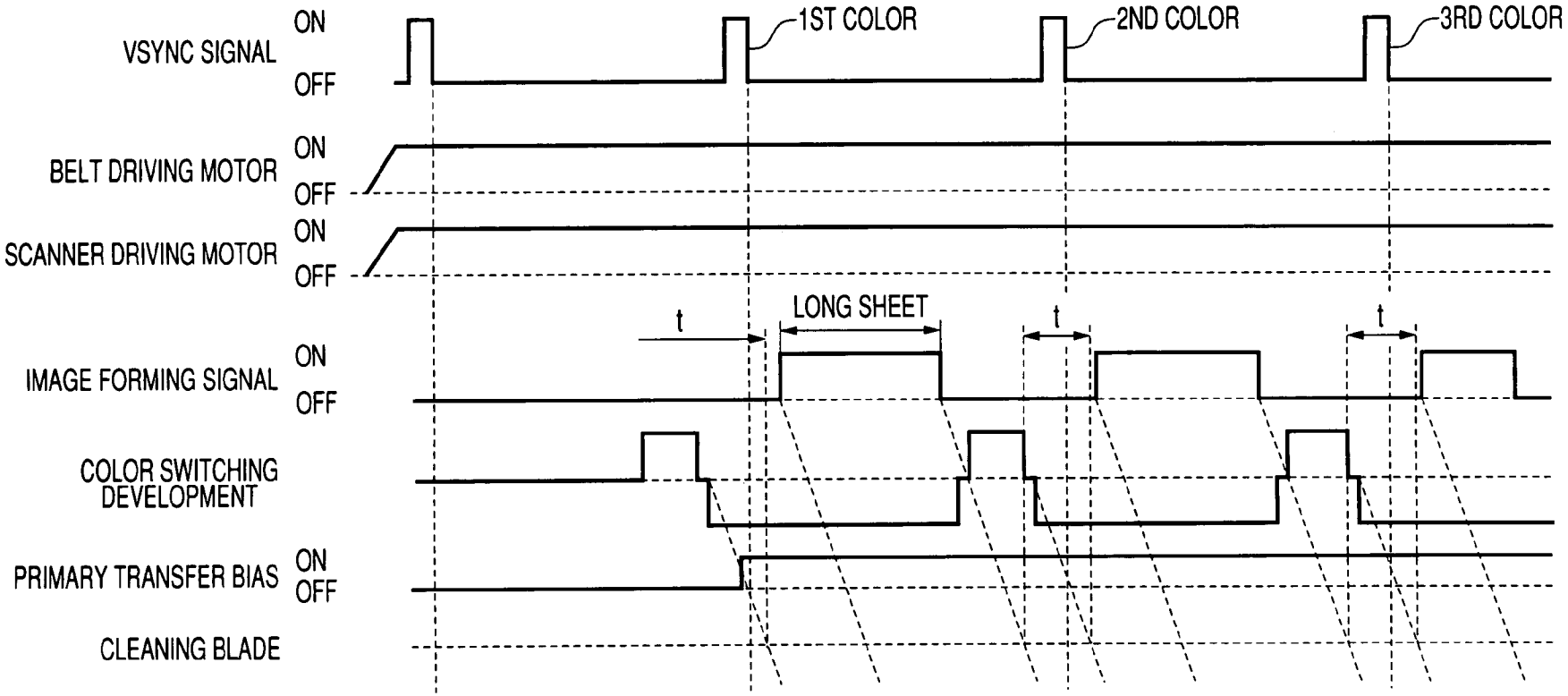

Similarly, in a case where the image formation is performed for a single page of image data for a long sheet (e.g., B4 size, A3 size), there is a spare time period for performing the color switching operation as shown in FIG. 28. Accordingly, the start timing of the color switching operation is brought forward as shown in FIG. 30, so that the time period t in which the rotation velocity fluctuation of the photosensitive drum 3 tends to be occurred can be finished before the exposure processing for the next color is started. Accordingly, an electrostatic latent image for the next color can be formed stably and accurately.

Figure 31:
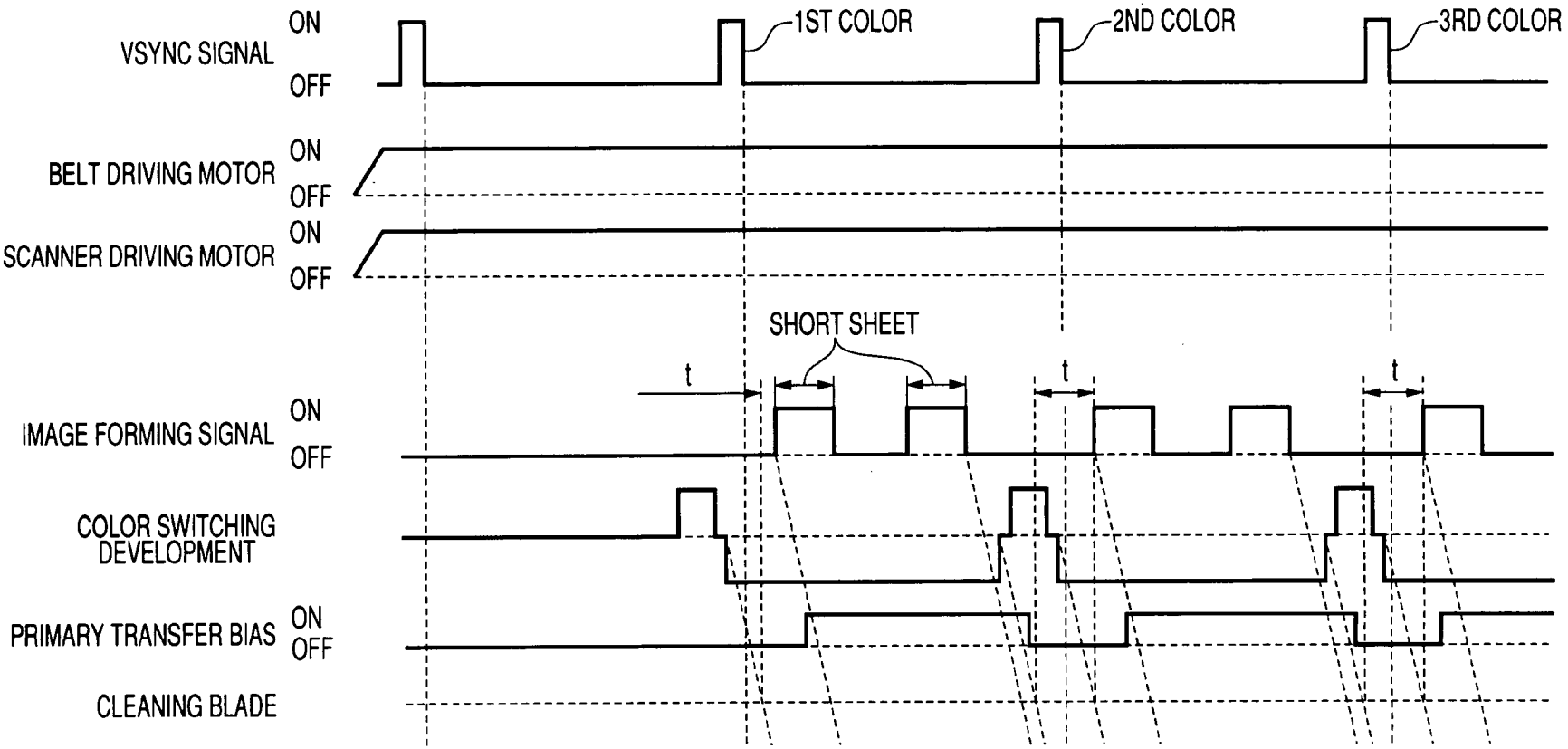

Similarly, in a case where the image formation is performed for two pages of image data for a short sheet (e.g., B5 size, post card size), there is a spare time period for performing the color switching operation as shown in FIG. 28. Accordingly, the start timing of the color switching operation is brought forward as shown in FIG. 31, so that the time period t in which the rotation velocity fluctuation of the photosensitive drum 3 tends to be occurred can be finished before the exposure processing for the next color is started. Accordingly, an electrostatic latent image for the next color can be formed stably and accurately.

Consequently, the CPU 51 of the engine controller 50 first performs the color switching operation of the rotary development unit 8 so that the developing roller 6*a* for the first color (black) is placed at the developing position irrespective of the necessity of the dummy image. This operation is executed in accordance with the control program stored in the ROM 52. The necessity of the dummy image is then judged in accordance with a table shown in FIG. 32 stored in the ROM 52 in advance.

Specifically, in a case where the image data for two pages of medium sheets is received, the processing for forming a dummy image 35 on the intermediate transfer belt 12 is activated. For any other case, the color switching operation of the rotary development unit 8 is executed without forming the dummy image, so that the color switching operation is finished before the exposure processing for the next color is started.

That is, the dummy image 35 is formed and the toner d is reversely supplied to the photosensitive drum 3 only in a case where the developing roller 6*a* cannot be brought into contact with a region on the photosensitive drum 3 where is to come in contact with the cleaner blade 7*a* during the exposure processing for the actual image. The reversely supplied toner d serves as a lubricant for effecting the smooth contact of the cleaner blade 7*a* with respect to the photosensitive drum 3. Therefore, the rotation velocity fluctuation of the photosensitive drum 3 can be avoided while preventing toner being excessively consumed.

In the embodiment, the necessity of the dummy image 35 is judged every time the image data is received. Therefore, the rotation velocity fluctuation of the photosensitive drum 3 can be reliably avoided while preventing toner being excessively consumed. As a result, high quality images can be obtained with low cost.

In this embodiment, the necessity of the dummy image 35 is judged in accordance with the size of recording medium subjected to the image forming operation. However, the necessity may be judged in accordance with the size of actual image to be formed (i.e., the area of the actual image to be formed). For example, in a case where the received image data is for A4 size sheets but requires a small area in the A4 size sheet (i.e., in a case where an enough spare time can be secured after the completion of the exposure processing), the color switching operation of the rotary development unit 8 may be immediately performed without executing the processing for forming the dummy image.

In this embodiment, in a case where the received image data is for a single page, it is judged that the dummy image formation is not necessary irrespective of the size of recording medium. Accordingly, the necessity of the dummy image may be judged in accordance with only the number of actual image to be formed during the one circulation of the intermediate transfer belt 12. In this case, the processing can be simplified and the processing speed can be increased.

Figure 33:
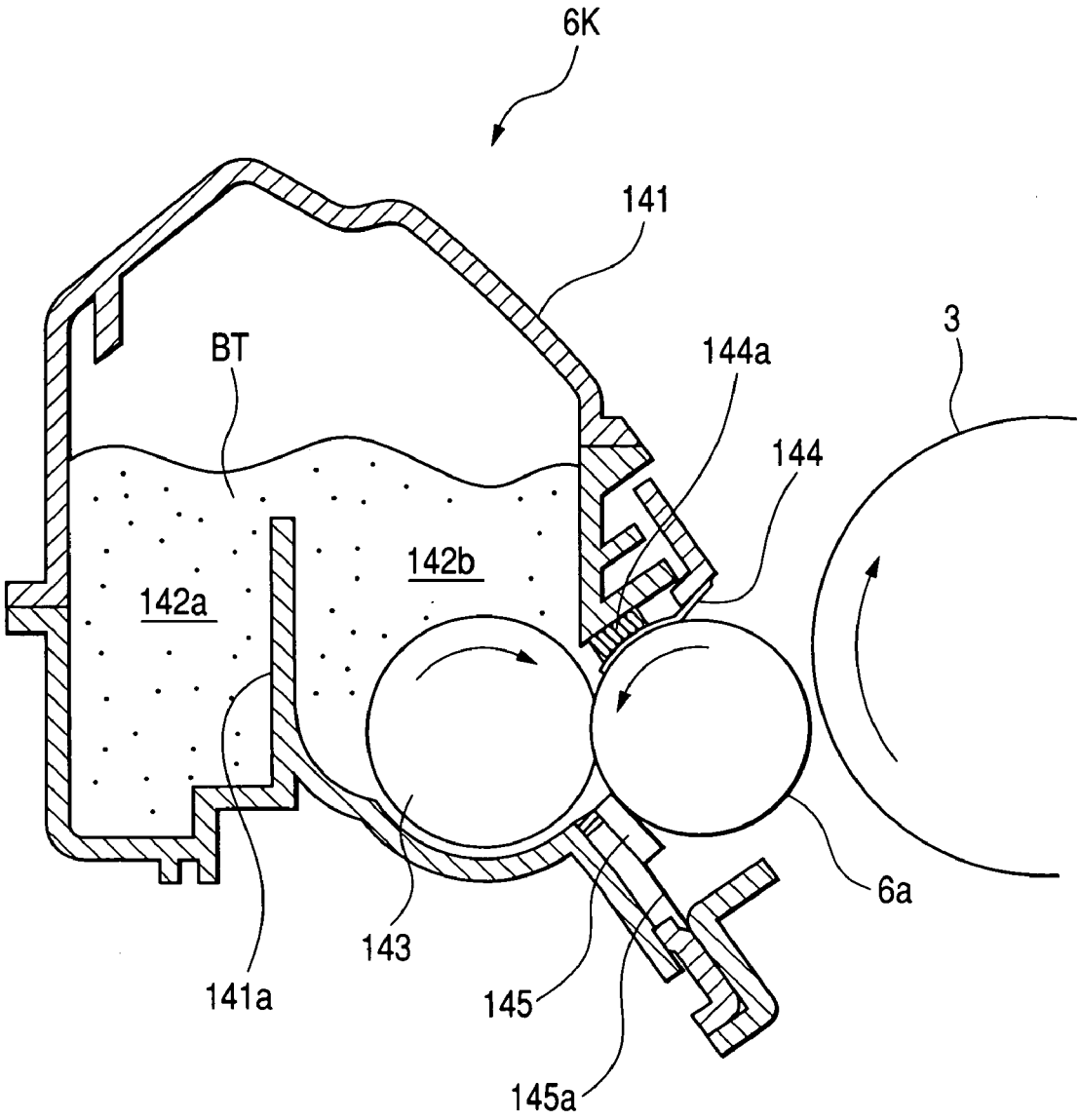
FIG. 33 is a section view of a developer in the image forming apparatus of FIG. 1.

The structure of the developers 6 (C, M, Y, K) will be described with reference to FIG. 33. For example, the developer 6K accommodates black toner BT comprises a housing 141 in which first and second chambers 142*a* and 142*b* are defined by a partition plate 141*a*. A supply roller 143 is disposed within the second housing 142*b* while being in pressure contact with the developing roller 6*a*.

In accordance with the rotation of the rotary development unit 8, the accommodated toner BT is moved from the first chamber 142*a* to the second chamber 142*b*, so that the toner BT is supplied to the developing roller 6*a* via the supply roller 143. Strictly speaking, the developing roller 6*a* is configured so as to oppose to the photosensitive drum 3 while defining a minute clearance therebetween. An electrostatic latent image formed on the photosensitive drum 3 is developed by the supplied toner without direct contact with the developing roller 6*a*. That is, the developing roller 6*a* is neither abraded nor deteriorated due to the direct contact with the photosensitive drum 3 but is rather abraded and deteriorated due to the contact with the supply roller 143 or the toner. For the same reason, the stopping developing roller 6*a* is neither abraded nor deteriorated due to a pressure contact with the rotating photosensitive drum 3.

A sealer 144 urged by an urging member 144*a* and a control blade 145 urged by an urging member 145*a* are brought into press contact with the outer periphery of the developing roller 6*a*. The sealer 144 prevents the toner BT from leaking out of the housing 141 while the toner BT on the developing roller 6*a* passing through the developing position are collected into the housing 141 without being scraped. On the other hand, a portion of the control blade 145 shifted from the tip end thereof toward the proximal end thereof is brought into press contact with the surface of the developing roller 6*a*, thereby scraping off excess toner BT and regulating a thickness of toner on the developing roller 6*a* to be constant.

Thus, the toner circulated in the housing 141 rubs and is thus deteriorated slightly, and furthermore, the developing roller 6*a* is also abraded slightly and deteriorated. For this reason, in a case where a monochromatic image is to be continuously formed on a plurality of recording media, a deterioration in toner and the developing roller 6*a* for the same color progresses. In general, the toner BT and the developing roller 6*a* in the developer 6K are deteriorated more remarkably than other colors and an exchange is required in an early stage.

In this embodiment, in order to suppress the deterioration in the toner BT and the developing roller 6*a*, even when a monochromatic image is formed, the CPU 51 of the engine controller 50 adjusts the timings for rotating or stopping the developing roller 6*a* and the supply roller 143 through the development controller 57 in accordance with a control program stored in the ROM 52.

Figure 34:
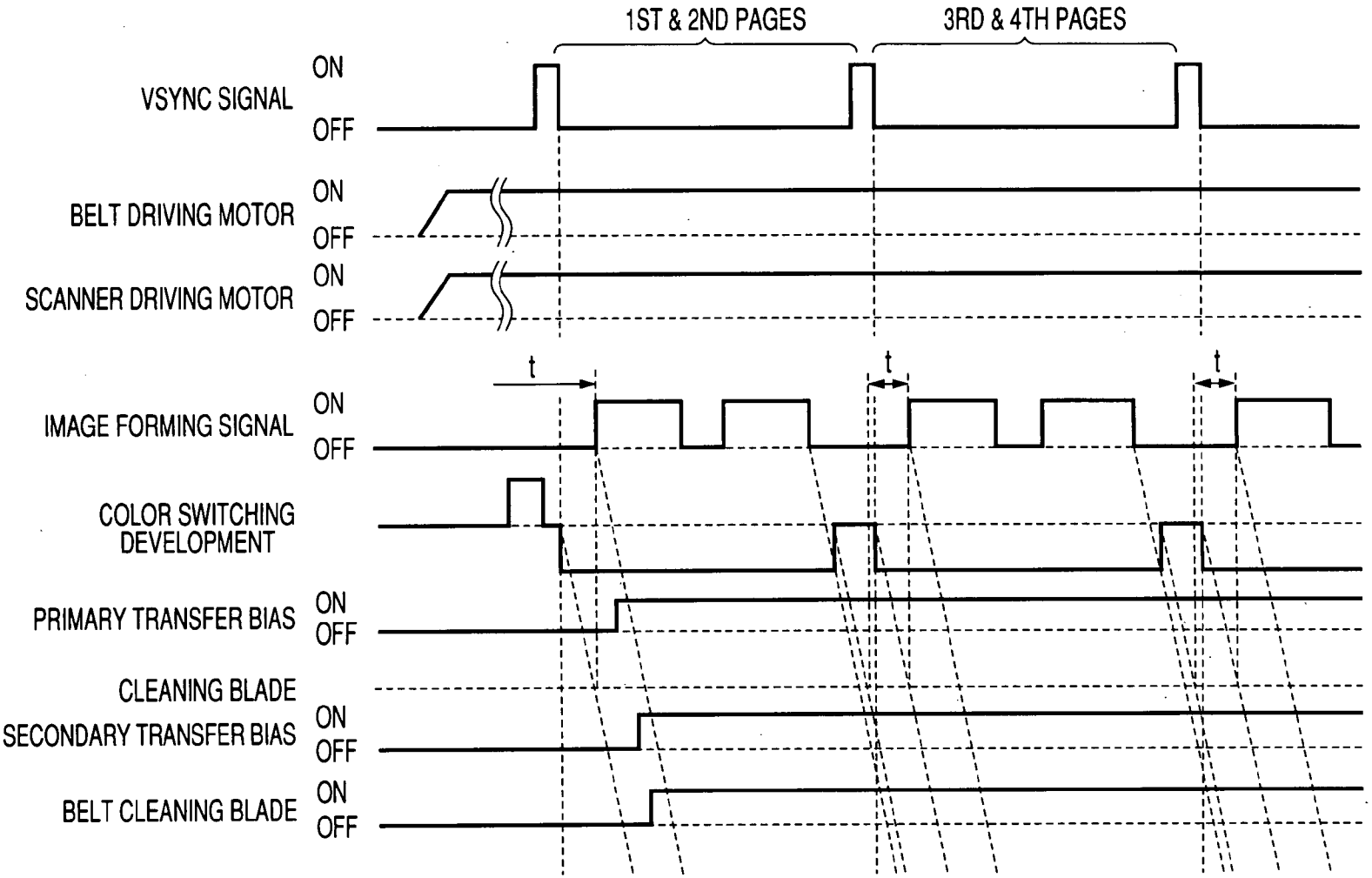
FIG. 34 is a diagram for explaining a control sequence according to a sixth embodiment of the invention.
Figure 35:
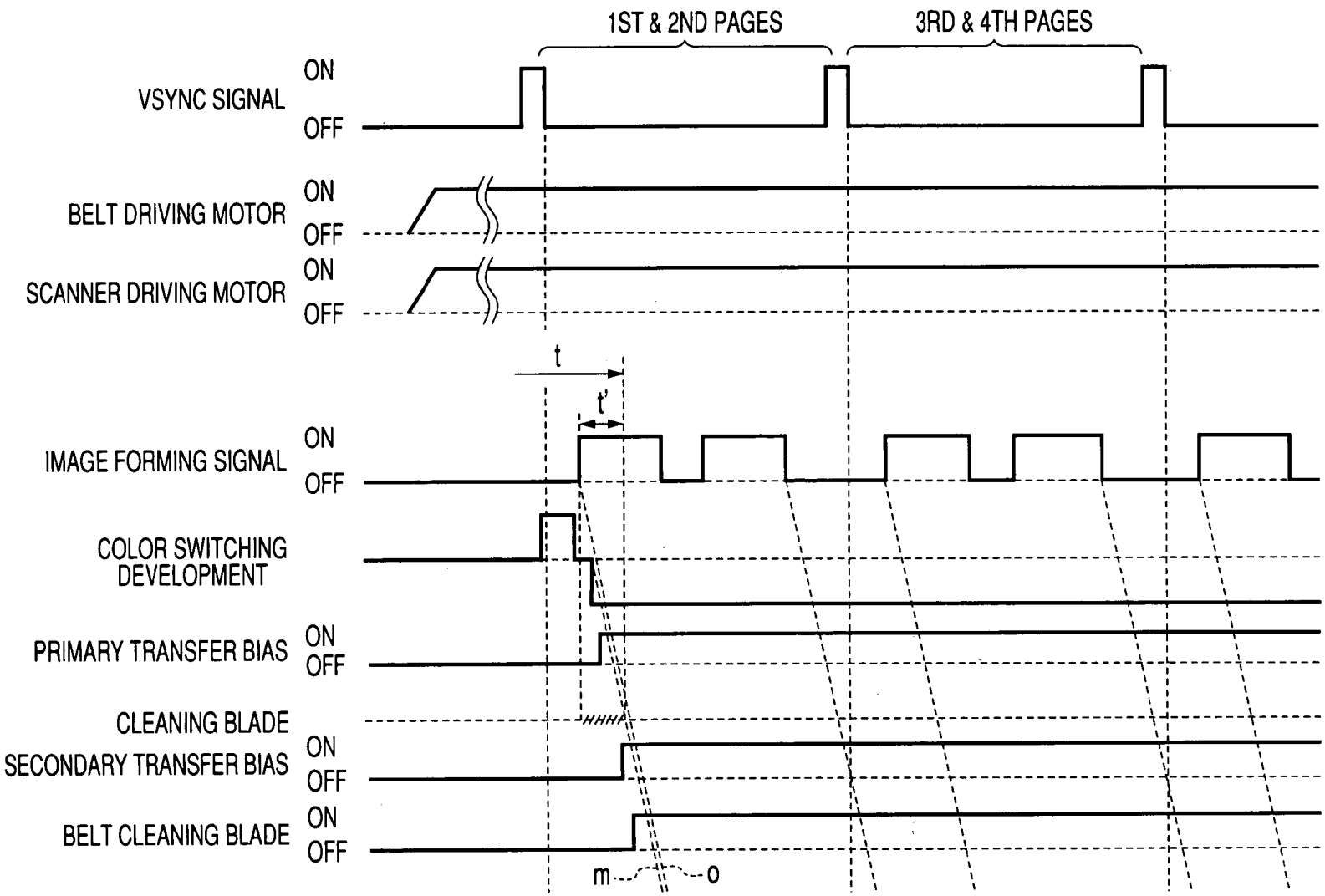
FIG. 35 is a diagram for explaining a control sequences in a first related-art image forming apparatus.
Figure 36:
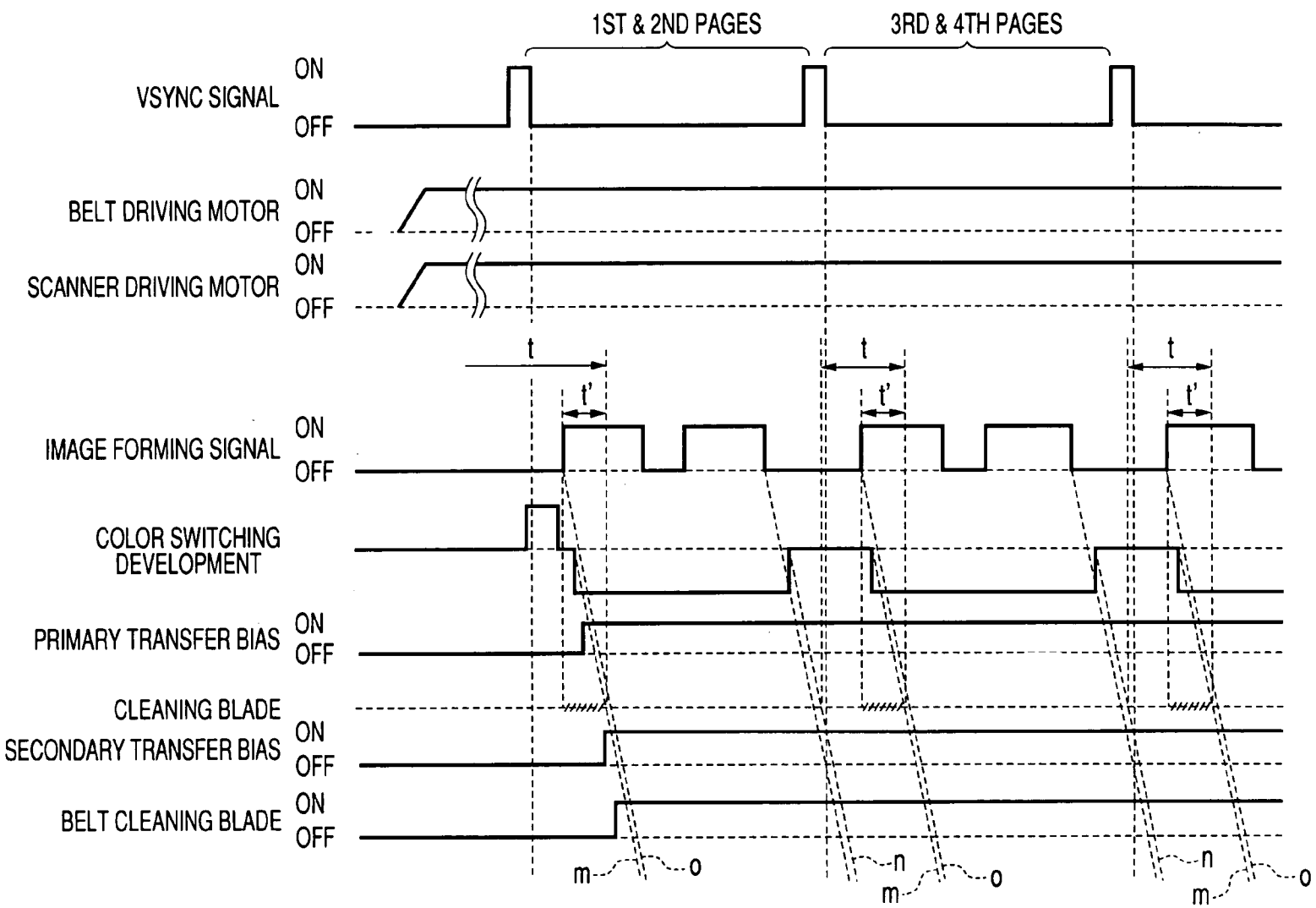
FIG. 36 is a diagram for explaining a control sequences in a second related-art image forming apparatus.

Specifically, as shown in FIG. 34, the CPU 51 of the engine controller 50 executes the color switching operation of the rotary development unit 8 to place the developing roller 6*a* at the developing position, and starts to rotate the developing roller 6*a* to supply toner onto a region on the photosensitive drum 3 where is to come in contact with the cleaner blade 7*a* during the exposure processing for the image data of the first page.

Moreover, the CPU 51 stops the rotation of the developing roller 6*a* and the supply roller 143 immediately after the completion of the development for the actual image of the second page. After then, the rotation of the developing roller 6*a* is restarted such that toner is supplied onto a region on the photosensitive drum 3 where is to come in contact with the cleaner blade 7*a* during the exposure processing for the image data of the next page.

That is, the development roller 6*a* and the supply roller 143 in the developer 6 are rotated to supply toner to the photosensitive drum 3 in such a manner that a region on the photosensitive drum 3 where is to come in contact with the cleaner blade 7*a* during the exposure processing is necessarily covered with the supplied toner. On the other hand, the development roller 6*a* and the supply roller 143 in the developer 6 are stopped supplying toner to a region on the photosensitive drum 3 where is not to come in contact with the cleaner blade 7*a* during the exposure processing. Accordingly, the rotation velocity fluctuation of the photosensitive drum 3 due to the frictional contact of the cleaner blade 7*a* can be avoided while saving the toner consumption. As a result, an electrostatic latent image is formed with high accuracy, thereby obtaining an output image with high quality. Furthermore, since the deterioration of the toner and the developer can be suppressed, thereby enhancing the durability thereof.

What is claimed is:

1. An image forming apparatus, comprising:

a rotary image carrier, on which an electrostatic latent image is formed;

a developer, comprising at least one developing roller which is separatably abutted on the image carrier at a developing position to supply toner onto the image carrier to make the latent image visible as a toner image;

an intermediate transfer member, adapted to temporarily hold the toner image;

a transferer, which applies a transfer bias to primarily transfer the toner image on the image carrier to the intermediate transfer member;

a first cleaner, always abutted on the image carrier to remove toner remaining thereon; and a second cleaner, separatably abutted on the intermediate transfer member to remove toner remaining thereon, wherein:

the toner image includes a first toner image which is not to be transferred onto the recording medium and a second toner image which is to be secondarily transferred onto a recording medium; and the second cleaner is separated from the intermediate transfer member so as to avoid the first toner image.

2. The image forming apparatus as set forth in claim 1, wherein:

the first toner image is removed from the intermediate transfer member by the second cleaner when a prescribed number of the second toner image is formed; and the first toner image is again formed when the first toner image is removed from the intermediate transfer member.

3. The image forming apparatus as set forth in claim 1, wherein the transfer bias is lowered to reversely transfer the first toner image from the intermediate transfer member to the image carrier.

4. The image forming apparatus as set forth in claim 3, wherein the transfer bias is turned off.

5. The image forming apparatus as set forth in claim 3, wherein the polarity of the transfer bias is inversed.

6. The image forming apparatus as set forth in claim 3, wherein the transfer bias is lowered in accordance with a toner amount of the first toner image.

7. The image forming apparatus as set forth in claim 6, wherein the toner amount is judged in accordance with a pattern of the first toner image.

8. The image forming apparatus as set forth in claim 6, wherein the toner amount is judged in accordance with the number of times that the developing roller is separated from the image carrier.

9. The image forming apparatus as set forth in claim 1, wherein the first toner image is formed before the latent image formation for the second toner image is started.

10. The image forming apparatus as set forth in claim 1, wherein the first toner image on the intermediate transfer member opposes at least a region on the image carrier which will come in contact with the first cleaner when the latent image formation for the second toner image is performed.

11. The image forming apparatus as set forth in claim 1, wherein the first toner image on the intermediate transfer member opposes a region on the image carrier from which the developing roller is separated.

12. The image forming apparatus as set forth in claim 1, wherein the developer is a rotary unit which comprises a plurality of developing rollers such that one of the developing rollers is selectably abutted on the image carrier.

13. The image forming apparatus as set forth in claim 12, wherein each of the developing rollers is associated with one of different colors of toner.

14. The image forming apparatus as set forth in claim 1, wherein:

the intermediate transfer member is a belt member having a first face on which the first toner image and the second toner image is formed;

the transferer includes a roller member abutted on a second face of the belt member, thereby bringing the first face of the belt memeber into pressure contact with the image carrier; and a diameter of a center portion of the roller member in an axial direction thereof is greater than diameters of both ends of the roller member in the axial direction thereof, thereby serving as the pressure adjuster.

15. An image forming apparatus, comprising:

a rotary image carrier, on which an electrostatic latent image is formed;

a developer, comprising at least one developing roller which is separatably abutted on the image carrier at a developing position to supply toner onto the image carrier to make the latent image visible as a toner image;

an intermediate transfer member, adapted to temporarily hold the toner image;

a transferer, which applies a transfer bias to primarily transfer the toner image on the image carrier to the intermediate transfer member;

a first cleaner, always abutted on the image carrier to remove toner remaining thereon; and a second cleaner, separatably abutted on the intermediate transfer member to remove toner remaining thereon, wherein:

the toner image includes a first toner image which is not to be transferred onto the recording medium and a second toner image which is to be secondarily transferred onto a recording medium; and the first toner image is formed before the latent image formation for the second toner image is started.

16. The image forming apparatus as set forth in claim 15, wherein the second cleaner is separated from the intermediate transfer member so as to avoid the first toner image.

17. The image forming apparatus as set forth in claim 15, wherein:

the first toner image is removed from the intermediate transfer member by the second cleaner when a prescribed number of the second toner image is formed; and the first toner image is again formed when the first toner image is removed from the intermediate transfer member.

18. The image forming apparatus as set forth in claim 15, wherein the transfer bias is lowered to reversely transfer the first toner image from the intermediate transfer member to the image carrier.

19. The image forming apparatus as set forth in claim 18, wherein the transfer bias is turned off.

20. The image forming apparatus as set forth in claim 18, wherein the polarity of the transfer bias is inversed.

21. The image forming apparatus as set forth in claim 18, wherein the transfer bias is lowered in accordance with a toner amount of the first toner image.

22. The image forming apparatus as set forth in claim 21, wherein the toner amount is judged in accordance with a pattern of the first toner image.

23. The image forming apparatus as set forth in claim 21, wherein the toner amount is judged in accordance with the number of times that the developing roller is separated from the image carrier.

24. The image forming apparatus as set forth in claim 15, wherein the first toner image on the intermediate transfer member opposes at least a region on the image carrier which will come in contact with the first cleaner when the latent image formation for the second toner image is performed.

25. The image forming apparatus as set forth in claim 15, wherein the first toner image on the intermediate transfer member opposes a region on the image carrier from which the developing roller is separated.

26. The image forming apparatus as set forth in claim 15, wherein the developer is a rotary unit which comprises a plurality of developing rollers such that one of the developing rollers is selectably abutted on the image carrier.

27. The image forming apparatus as set forth in claim 26, wherein each of the developing rollers is associated with one of different colors of toner.

28. An image forming apparatus, comprising:

a rotary image carrier, on which an electrostatic latent image is formed;

a developer, comprising at least one developing roller which is separatably abutted on the image carrier at a developing position to supply toner onto the image carrier to make the latent image visible as a toner image;

an intermediate transfer member, adapted to temporarily hold the toner image;

a transferer, which applies a transfer bias to primarily transfer the toner image on the image carrier to the intermediate transfer member;

a first cleaner, always abutted on the image carrier to remove toner remaining thereon; and a second cleaner, separatably abutted on the intermediate transfer member to remove toner remaining thereon, wherein:

the toner image includes a first toner image which is not to be transferred onto the recording medium and a second toner image which is to be secondarily transferred onto a recording medium; and the first toner image on the intermediate transfer member opposes at least a region on the image carrier which will come in contact with the first cleaner when the latent image formation for the second toner image is performed.

29. The image forming apparatus as set forth in claim 28, wherein the second cleaner is separated from the intermediate transfer member so as to avoid the first toner image.

30. The image forming apparatus as set forth in claim 28, wherein:

the first toner image is removed from the intermediate transfer member by the second cleaner when a prescribed number of the second toner image is formed; and the first toner image is again formed when the first toner image is removed from the intermediate transfer member.

31. The image forming apparatus as set forth in claim 28, wherein the transfer bias is lowered to reversely transfer the first toner image from the intermediate transfer member to the image carrier.

32. The image forming apparatus as set forth in claim 31, wherein the transfer bias is turned off.

33. The image forming apparatus as set forth in claim 31, wherein the polarity of the transfer bias is inversed.

34. The image forming apparatus as set forth in claim 31, wherein the transfer bias is lowered in accordance with a toner amount of the first toner image.

35. The image forming apparatus as set forth in claim 34, wherein the toner amount is judged in accordance with a pattern of the first toner image.

36. The image forming apparatus as set forth in claim 34, wherein the toner amount is judged in accordance with the number of times that the developing roller is separated from the image carrier.

37. The image forming apparatus as set forth in claim 28, wherein the first toner image is formed before the latent image formation for the second toner image is started.

38. The image forming apparatus as set forth in claim 28, wherein the first toner image on the intermediate transfer member opposes a region on the image carrier from which the developing roller is separated.

39. The image forming apparatus as set forth in claim 28, wherein the developer is a rotary unit which comprises a plurality of developing rollers such that one of the developing rollers is selectably abutted on the image carrier.

40. The image forming apparatus as set forth in claim 39, wherein each of the developing rollers is associated with one of different colors of toner.

41. An image forming apparatus, comprising:

a rotary image carrier, on which an electrostatic latent image is formed;

a developer, comprising at least one developing roller which is separatably abutted on the image carrier at a developing position to supply toner onto the image carrier to make the latent image visible as a toner image;

an intermediate transfer member, adapted to temporarily hold the toner image;

a transferer, which applies a transfer bias to primarily transfer the toner image on the image carrier to the intermediate transfer member;

a first cleaner, always abutted on the image carrier to remove toner remaining thereon; and a second cleaner, separatably abutted on the intermediate transfer member to remove toner remaining thereon, wherein:

the toner image includes a first toner image which is not to be transferred onto the recording medium and a second toner image which is to be secondarily transferred onto a recording medium; and the first toner image is again formed when a prescribed number of the second toner image is formed.

42. The image forming apparatus as set forth in claim 41, wherein the second cleaner is separated from the intermediate transfer member so as to avoid the first toner image.

43. The image forming apparatus as set forth in claim 41, wherein the first toner image is removed from the intermediate transfer member by the second cleaner when the prescribed number of the second toner image is formed.

44. The image forming apparatus as set forth in claim 41, wherein the transfer bias is lowered to reversely transfer the first toner image from the intermediate transfer member to the image carrier.

45. The image forming apparatus as set forth in claim 44, wherein the transfer bias is turned off.

46. The image forming apparatus as set forth in claim 44, wherein the polarity of the transfer bias is inversed.

47. The image forming apparatus as set forth in claim 44, wherein the transfer bias is lowered in accordance with a toner amount of the first toner image.

48. The image forming apparatus as set forth in claim 47, wherein the toner amount is judged in accordance with a pattern of the first toner image.

49. The image forming apparatus as set forth in claim 47, wherein the toner amount is judged in accordance with the number of times that the developing roller is separated from the image carrier.

50. The image forming apparatus as set forth in claim 41, wherein the first toner image is formed before the latent image formation for the second toner image is started.

51. The image forming apparatus as set forth in claim 41, wherein the first toner image on the intermediate transfer member opposes at least a region on the image carrier which will come in contact with the first cleaner when the latent image formation for the second toner image is performed.

52. The image forming apparatus as set forth in claim 41, wherein the first toner image on the intermediate transfer member opposes a region on the image carrier from which the developing roller is separated.

53. The image forming apparatus as set forth in claim 41, wherein the developer is a rotary unit which comprises a plurality of developing rollers such that one of the developing rollers is selectably abutted on the image carrier.

54. The image forming apparatus as set forth in claim 53, wherein each of the developing rollers is associated with one of different colors of toner.

55. An image forming apparatus, comprising:

a rotary image carrier, on which an electrostatic latent image is formed;

a developer, comprising at least one developing roller which is separatably abutted on the image carrier at a developing position to supply toner onto the image carrier to make the latent image visible as a toner image;

an intermediate transfer member, adapted to temporarily hold the toner image;

a transferer, which applies a transfer bias to primarily transfer the toner image on the image carrier to the intermediate transfer member, the toner image including a first toner image which is not to be transferred onto the recording medium and a second toner image which is to be secondarily transferred onto a recording medium;

a cleaner, always abutted on the image carrier to remove toner remaining thereon; and a pressure adjuster, which applies a uniform pressure to an entire area of the first toner image at least when the first toner image opposes to the image carrier.

56. The image forming apparatus as set forth in claim 55, wherein the transfer bias is lowered to reversely transfer the first toner image from the intermediate transfer member to the image carrier.

57. The image forming apparatus as set forth in claim 56, wherein the transfer bias is turned off.

58. The image forming apparatus as set forth in claim 56, wherein the polarity of the transfer bias is inversed.

59. An image forming apparatus, comprising:

a rotary image carrier, on which an electrostatic latent image is formed;

a developer, comprising at least one developing roller which is separatably abutted on the image carrier at a developing position to supply toner onto the image carrier to make the latent image visible as a toner image;

an intermediate transfer member, adapted to temporarily hold the toner image;

a transferer which applies a transfer bias to primarily transfer the toner image on the image carrier to the intermediate transfer member; and a cleaner, always abutted on the image carrier to remove toner remaining thereon; wherein:

the toner image includes a first toner image which is not to be transferred onto the recording medium and a second toner image which is to be secondarily transferred onto a recording medium; and the first toner image includes a plurality of straight lines.

60. The image forming apparatus as set forth in claim 59, wherein the lines extend in a first direction perpendicular to a rotating direction of the image carrier, and are arrayed in a second direction parallel to the rotating direction.

61. The image forming apparatus as set forth in claim 59, wherein the lines obliquely extend in a direction parallel to a rotating direction of the image carrier.

62. The image forming apparatus as set forth in claim 59, wherein the lines extend in a first direction parallel to a rotating direction of the image carrier, and are arrayed in a second direction perpendicular to the rotating direction.

63. The image forming apparatus as set forth in claim 59, wherein the transfer bias is lowered to reversely transfer the first toner image from the intermediate transfer member to the image carrier.

64. The image forming apparatus as set forth in claim 63, wherein the transfer bias is turned off.

65. The image forming apparatus as set forth in claim 63, wherein the polarity of the transfer bias is inversed.

66. An image forming apparatus, comprising:

a rotary image carrier, on which an electrostatic latent image is formed;

a developer, comprising at least one developing roller which is separatably abutted on the image carrier at a developing position to supply toner onto the image carrier to make the latent image visible as a toner image;

an intermediate transfer member, adapted to temporarily hold the toner image;

a transferer, which applies a transfer bias to primarily transfer the toner image on the image carrier to the intermediate transfer member; and a cleaner, always abutted on the image carrier to remove toner remaining thereon; wherein:

the toner image includes a first toner image which is not to be transferred onto the recording medium and a second toner image which is to be secondarily transferred onto a recording medium; and the first toner image includes at least one of a halftone uniform image and a halftone dot image.

67. The image forming apparatus as set forth in claim 66, wherein the transfer bias is lowered to reversely transfer the first toner image from the intermediate transfer member to the image carrier.

68. The image forming apparatus as set forth in claim 67, wherein the transfer bias is turned off.

69. The image forming apparatus as set forth in claim 67, wherein the polarity of the transfer bias is inversed.

70. An image forming apparatus, comprising:

a rotary image carrier, on which an electrostatic latent image is formed;

a developer, comprising at least one developing roller which is separatably abutted on the image carrier at a developing position to supply toner onto the image carrier to make the latent image visible as a toner image;

an intermediate transfer member, adapted to temporarily hold the toner image;

a transferer which applies a transfer bias to primarily transfer the toner image on the image carrier to the intermediate transfer member; and a cleaner, always abutted on the image carrier to remove toner remaining thereon; wherein:

the toner image includes a first toner image which is not to be transferred onto the recording medium and a second toner image which is to be secondarily transferred onto a recording medium; and the first toner image is formed in a case where a region which has been subjected to the toner removal by the cleaner comes in contact with the cleaner again before the latent image formation for the second toner image is started.

71. The image forming apparatus as set forth in claim 70, wherein it is determined whether the first toner image should be formed in accordance with a size of the second toner image.

72. The image forming apparatus as set forth in claim 70, wherein it is determined whether the first toner image should be formed in accordance with a size of the recording medium.

73. The image forming apparatus as set forth in claim 70, wherein:

the intermediate transfer member is an endless belt member to be circulated; and it is determined whether the first toner image should be formed in accordance with the number of the second toner image formed on the endless belt member.

74. The image forming apparatus as set forth in claim 70, wherein the first toner image is not formed in a case where the region does not come in contact with the cleaner again before the latent image formation for the second toner image is started.

75. The image forming apparatus as set forth in claim 70, wherein the transfer bias is lowered to reversely transfer the first toner image from the intermediate transfer member to the image carrier.

76. The image forming apparatus as set forth in claim 75, wherein the transfer bias is turned off.

77. The image forming apparatus as set forth in claim 75, wherein the polarity of the transfer bias is inversed.

78. An image forming apparatus, comprising:

a rotary image carrier, on which an electrostatic latent image is formed;

a developer, comprising at least one developing roller which is separatably abutted on the image carrier at a developing position to supply toner onto the image carrier to make the latent image visible as a toner image;

an intermediate transfer member, adapted to temporarily hold the toner image;

a transferer, which applies a transfer bias to primarily transfer the toner image on the image carrier to the intermediate transfer member; and a cleaner, always abutted on the image carrier to remove toner remaining thereon, wherein the development roller is rotated to start supplying toner in a case where a region where has been subjected to the toner removal by the cleaner comes in contact with the cleaner again before the latent image formation is started.

79. The image forming apparatus as set forth in claim 78, wherein the developing roller is stopped in a case where the region does not come in contact with the cleaner again before the latent image formation for the second toner image is started.

80. The image forming apparatus as set forth in claim 78, wherein:

the intermediate transfer belt is an endless belt member to be circulated; and the developing roller is stopped after the toner image formation for every circulation of the endless belt member.

81. The image forming apparatus as set forth in claim 80, wherein the developer is a rotary unit which comprises a plurality of developing rollers such that one of the developing rollers is selectably abutted on the image carrier.

82. The image forming apparatus as set forth in claim 81, wherein each of the developing rollers is placed at the developing position before the region reaches the developing position.

83. The image forming apparatus as set forth in claim 81, wherein the developing roller is stopped every time when the development for one color is finished.

84. The image forming apparatus as set forth in claim 81, wherein each of the developing rollers is associated with one of different colors of toner.

* * * * *